US010991495B2

(12) United States Patent
Yoshidome et al.

(10) Patent No.: US 10,991,495 B2
(45) Date of Patent: Apr. 27, 2021

(54) SOFT MAGNETIC ALLOY AND MAGNETIC COMPONENT

(71) Applicant: TDK CORPORATION, Tokyo (JP)

(72) Inventors: Kazuhiro Yoshidome, Tokyo (JP); Hiroyuki Matsumoto, Tokyo (JP); Kenji Horino, Tokyo (JP); Akito Hasegawa, Tokyo (JP); Hajime Amano, Tokyo (JP); Kensuke Ara, Tokyo (JP); Akihiro Harada, Tokyo (JP)

(73) Assignee: TDK CORPORATION, Tokyo (JP)

( * ) Notice: Subject to any disclaimer, the term of this patent is extended or adjusted under 35 U.S.C. 154(b) by 373 days.

(21) Appl. No.: 16/221,977

(22) Filed: Dec. 17, 2018

(65) Prior Publication Data

US 2019/0214171 A1 Jul. 11, 2019

(30) Foreign Application Priority Data

Jan. 10, 2018 (JP) ..... JP2018-002049

(51) Int. Cl.

| | |
|---|---|
| ***H01F 1/26*** | (2006.01) |
| ***H01F 1/147*** | (2006.01) |
| ***H01F 1/38*** | (2006.01) |
| ***H01F 41/02*** | (2006.01) |
| ***H01F 1/153*** | (2006.01) |

(52) U.S. Cl.

CPC ..... *H01F 1/26* (2013.01); *H01F 1/14708* (2013.01); *H01F 1/14766* (2013.01); *H01F 1/15308* (2013.01); *H01F 1/38* (2013.01); *H01F 41/0226* (2013.01); *H01F 41/0246* (2013.01); *H01F 1/15333* (2013.01)

(58) Field of Classification Search

CPC ..... H01F 1/15308; H01F 1/15333; H01F 1/14708; H01F 1/14766; H01F 1/26; H01F 1/38; H01F 41/0226; H01F 41/0246; H01F 1/15341

See application file for complete search history.

(56) References Cited

U.S. PATENT DOCUMENTS

| | | | | |
|---|---|---|---|---|
| 5,966,064 | A | 10/1999 | Yoshizawa et al. | |
| 2007/0126546 | A1 | 6/2007 | Guenther et al. | |
| 2011/0272065 | A1 | 11/2011 | Ohta et al. | |
| 2016/0319409 | A1* | 11/2016 | Theisen | C22C 33/003 |
| 2018/0169759 | A1* | 6/2018 | Nakamura | H01F 41/0246 |
| 2019/0362871 | A1* | 11/2019 | Urata | H01F 1/15308 |
| 2020/0291507 | A1* | 9/2020 | Ara | C22C 38/001 |

FOREIGN PATENT DOCUMENTS

| | | | |
|---|---|---|---|
| CN | 1105394 | A | 7/1995 |
| CN | 103500623 | A | 1/2014 |
| JP | 2011-149045 | A | 8/2011 |
| JP | 2015-167183 | A | 9/2015 |

* cited by examiner

*Primary Examiner* — Bernard Rojas
(74) *Attorney, Agent, or Firm* — Oliff PLC

(57) ABSTRACT

A soft magnetic alloy which includes nanocrystal parts and amorphous parts is provided. The nanocrystal parts include αFe(—Si) as a main component, and include at least one of elements selected from B, P, C, Ti, Zr, Hf, Nb, Ta, Mo, V, W, Cr, Al, Mn, Zn, and Cu as a sub-component. When a total content ratio of the sub-component in the nanocrystal parts is set as α (at %), and a total content ratio of the sub-components of the nanocrystal parts included in the amorphous parts is set as β (at %), $0.01 \leq (\alpha/\beta) \leq 0.40$, and a crystallinity degree is 5% or more and 70% or less.

11 Claims, 3 Drawing Sheets

SOFT MAGNETIC ALLOY AND MAGNETIC COMPONENT

BACKGROUND OF THE INVENTION

Field of the Invention

The present invention relates to a method for producing a soft magnetic dust core and a soft magnetic dust core.

Description of the Related Art

In recent years, low power consumption and high efficiency are required in electronic, information and communication equipment and the like. Furthermore, the above-described requirements are further enhanced to a low-carbon society. Therefore, reduction of energy loss or improvement of power source efficiency is also required in a power source circuit of electronic, information and communication equipment and the like. Besides, improvement of permeability and reduction of core loss are required for a core of a magnetic element used in the power source circuit. If the core loss is reduced, loss of electric energy is reduced, and high efficiency and energy conservation are realized.

Patent document 1 describes an invention of a dust core including nanocrystal soft magnetic alloy powder in which an αFe(—Si) crystal phase is partly deposited. However, nowadays a core which has a higher saturation magnetic flux density and a smaller core loss is required.

[Patent document 1] JP 2015-167183 A

As a method to reduce core loss of a core, reducing coercivity of a magnetic material constituting the core is considered.

SUMMARY OF THE INVENTION

An object of the present invention is to provide a soft magnetic alloy which has a low coercivity and a high saturation magnetic flux density.

To achieve the above object, the soft magnetic alloy according to the present invention is a soft magnetic alloy including nanocrystal parts and amorphous parts, wherein the nanocrystal parts include αFe(—Si) as a main component, and include at least one of elements selected from B, P, C, Ti, Zr, Hf, Nb, Ta, Mo, V, W, Cr, Al, Mn Zn, and Cu as a sub-component.

The soft magnetic alloy according to the present invention has a low coercivity and a high saturation magnetic flux density by having the above-described characteristics.

The soft magnetic alloy according to the present invention may satisfy a crystallinity degree is 15% or more and 70% or less.

The soft magnetic alloy according to the present invention may satisfy $0.5 \leq \alpha \leq 20$ in which a total content ratio of the sub-component in the nanocrystal parts is set as α (at %).

The soft magnetic alloy according to the present invention may satisfy $10 \leq \beta \leq 60$ in which a total content ratio of the sub-component of the nanocrystal parts included in the amorphous parts is set as β (at %).

The soft magnetic alloy according to the present invention may satisfy $0.05 < (\alpha/\beta) < 0.20$ in which a total content ratio of the sub-component in the nanocrystal parts is set as α (at %), the total content ratio of the sub-component of the nanocrystal parts included in the amorphous parts is set as β (at %).

The soft magnetic alloy according to the present invention may be represented by a composition formula $Fe_aCu_bM1_cSi_dM2_e$, in which M1 is at least one of elements selected from Ti, Zr, Hf, Nb, Ta, Mo, V, W, Cr, Al, Mn, and Zn;

M2 is at least one of elements selected from B, P, and C; and $$a+b+c+d+e=100$$

$0.0 \leq b \leq 3.0$ $0.0 \leq c \leq 15.0$ $0.0 \leq d \leq 17.5$ $0.0 \leq e \leq 20.0$.

The soft magnetic alloy according to the present invention may satisfy the soft magnetic is in a ribbon-like.

The soft magnetic alloy according to the present invention may satisfy the soft magnetic is in a powder-like.

A magnetic component according to the present invention includes the soft magnetic alloy described above.

DETAILED DESCRIPTION OF THE PREFERRED EMBODIMENTS

Hereinafter, embodiments of the present invention are described.

A soft magnetic alloy of the embodiment includes αFe(—Si) as a main component. Specifically, including αFe(—Si) as the main component refers to that a total content of αFe(—Si) in the entire soft magnetic alloy is 80 atom % or more. Furthermore, at least one of elements selected from B, P, C, Ti, Zr, Hf, Nb, Ta, Mo, V, W, Cr, Al, Mn, Zn, and Cu are included as a sub-component.

Hereinafter, a microstructure of the soft magnetic alloy of the embodiment is described with reference to the drawings.

Figure 1:
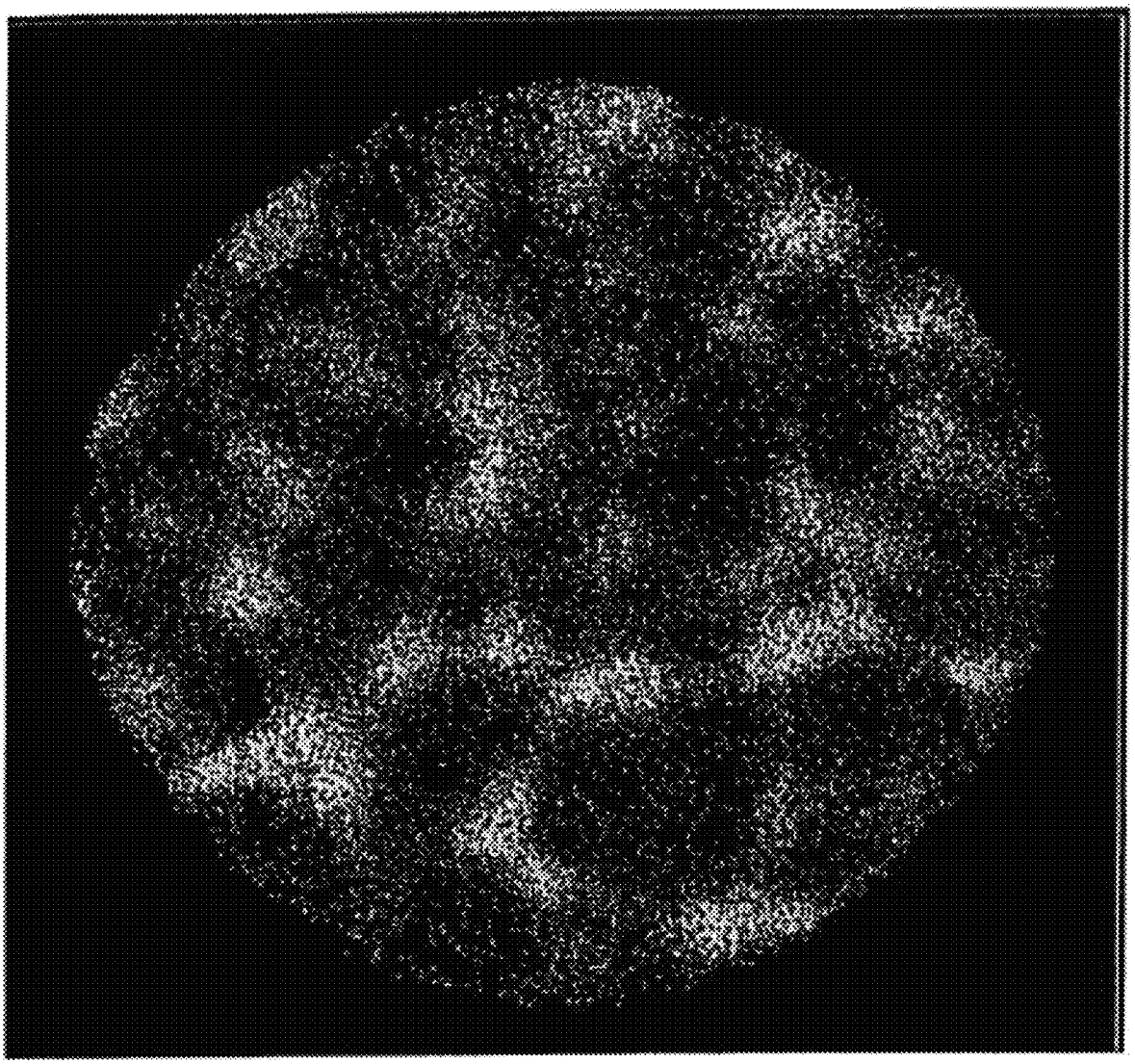
FIG. 1 is a result of observing a distribution of Fe in a soft magnetic alloy of the present invention by a 3DAP.

For the soft magnetic alloy of the embodiment, when a distribution of Fe is observed using a three-dimensional atom probe (sometimes referred to as 3DAP hereinafter) at a thickness of 5 nm, it can be observed as shown in FIG. 1 that there are parts having a high Fe content and parts having a low Fe content. Furthermore, FIG. 1 is a result of observing a example of a sample No. 54 described later using the 3DAP.

Figure 2:
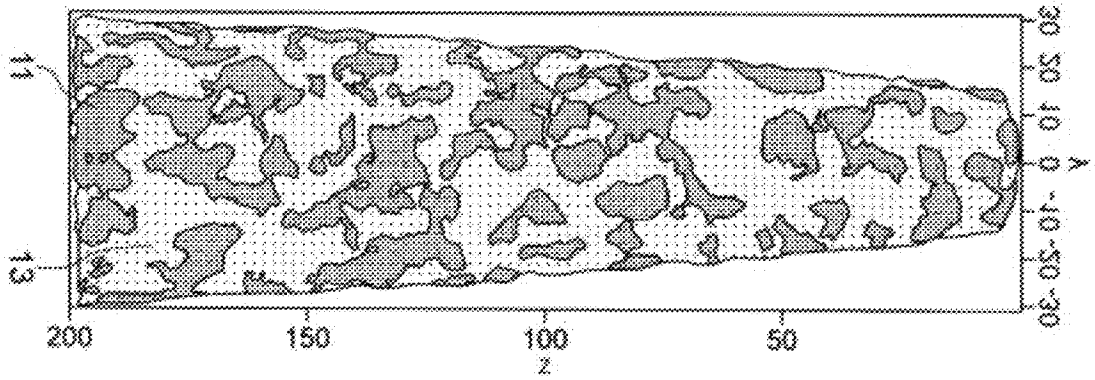
FIG. 2 is a schematic view showing a result of observing the soft magnetic alloy of the present invention by a 3DAP and binarizing the soft magnetic alloy by a Fe content.

Here, FIG. 2 is a schematic diagram of a result of binarizing the parts having a high Fe content and the parts having a low Fe content for other measurement sites different from the measurement sites in FIG. 1. Besides, the parts having a high Fe content are set as nanocrystal parts 11, and the parts having a low Fe content are set as amorphous parts 13. More specifically, with respect to an average composition of the entire soft magnetic alloy, the parts which have a Fe content higher than the average composition are set as the nanocrystal parts 11, and the parts which have a Fe content lower than the average composition and where Fe exists are set as the amorphous parts 13. It is considered that at least one portion of Fe and Si of the nanocrystal parts 11 exists in the form of αFe(—Si) nanocrystal. In the embodiment, a nanocrystal refers to a crystal which has a grain size of about 5 nm or higher and 50 nm or lower.

The soft magnetic alloy of the embodiment includes, in addition to Fe and Si, at least one of elements selected from B, P, C, Ti, Zr, Hf, Nb, Ta, Mo, V, W, Cr, Al, Mn, Zn, and Cu as the sub-component in the nanocrystal parts 11. By including the sub-component in the nanocrystal parts 11, oxidation resistance is improved. Furthermore, coercivity is reduced while maintaining saturation magnetic flux density. That is, soft magnetic characteristics are improved. In particular, soft magnetic characteristics suitable for high frequency regions are obtained.

A composition of the entire soft magnetic alloy can be confirmed by an ICP measurement and a fluorescent X-ray measurement. In addition, the composition of the nanocrystal parts and the composition of the amorphous parts can be measured by the 3DAP. Here, although Cu is added to the soft magnetic alloy, there are cases in which an amount of Cu detected from the nanocrystal parts and the amorphous parts is small or Cu is not detected from the nanocrystal parts and the amorphous parts. The reason is that crystallites of Cu exist independently from the nanocrystal parts and the amorphous parts. Furthermore, the crystallites of Cu are omitted in FIG. 2.

When a total content ratio of the sub-component in the nanocrystal parts 11 of the soft magnetic alloy of the embodiment is set as $\alpha$ (at %), it is preferable that $0.5 \leq \alpha \leq 20$, and more preferable that $1 \leq \alpha \leq 10$. In addition, when a total content ratio of the sub-component of the nanocrystal parts 11 included in the amorphous parts 13 is set as $\beta$ (at %), it is preferable that $10 \leq \beta \leq 60$, and more preferable that $20 \leq \beta \leq 50$. Furthermore, it is preferable that $0.00 < (\alpha/\beta) < 0.80$, and more preferable that $0.01 \leq (\alpha/\beta) \leq 0.75$.

The coercivity can be reduced and the soft magnetic characteristics can be improved by controlling the total content ratio a of the sub-component in the nanocrystal parts 11 to $0.5 \leq \alpha \leq 20$. The saturation magnetic flux density can be prevented from being reduced by further controlling the total content ratio $\beta$ of the sub-component of the nanocrystal parts 11 included in the amorphous parts 13 to $10 \leq \beta \leq 60$. That is, the soft magnetic characteristics are even better. Furthermore, an effect of the oxidation resistance is added by being $0.00 < (\alpha/\beta) < 0.80$, and the soft magnetic characteristics can be improved and an alloy with oxidation resistance can be made.

A crystallinity degree of the soft magnetic alloy of the embodiment is preferably 15% or more and 70% or less. The crystallinity degree of the soft magnetic alloy can be measured by powder X-ray diffraction. Specifically, after the soft magnetic alloy is made into powder, an X-ray diffraction pattern is obtained by an X-ray diffraction device (XRD). Then, asymmetry of the diffraction caused by background and the device is corrected. Thereafter, a diffraction pattern of the $\alpha$Fe(—Si) crystal and a specific diffraction pattern of the amorphous are separated, and respective diffraction intensity is obtained. Then, the crystallinity degree is obtained by calculating a ratio of the diffraction intensity of the $\alpha$Fe(—Si) crystal to the total diffraction intensity.

In addition, in the soft magnetic alloy of the embodiment, an average grain size of the nanocrystal is not particularly limited, and is preferably 5 nm or more and 50 nm or less. Furthermore, the average grain size of the nanocrystal can be measured by the powder X-ray diffraction using the XRD.

The composition of the soft magnetic alloy of the embodiment is arbitrary in addition to including $\alpha$Fe(—Si) as the main component and including the above-described elements as the sub-components. Preferably, the soft magnetic alloy is represented by the composition formula $Fe_aCu_bM1_cSi_dM2_e$, wherein M1 is at least one of elements selected from Ti, Zr, Hf, Nb, Ta, Mo, V, W, Cr, Al, Mn, and Zn; M2 is at least one of elements selected from B, P, and C; and $$a+b+c+d+e=100$$

$0.0 \leq b \leq 3.0$
$0.0 \leq c \leq 15.0$
$0.0 \leq d \leq 17.5$
$0.0 \leq e \leq 20.0$.

Furthermore, in the following disclosure, with regard to the content ratio of each element of the soft magnetic alloy, when a parameter is not particularly disclosed, the entire soft magnetic alloy is set to 100 atom %.

The Cu content (b) is preferably 3.0 atom % or less (including 0), and more preferably 1.0 atom % or less (including 0). That is, Cu may not be included. In addition, there is a trend that the lower the Cu content, the easier it is to make a ribbon made of the soft magnetic alloy by a single-roll method described later. On the other hand, the higher the Cu content, the smaller an average particle diameter of the nanocrystal can be, and the greater the effect of reducing the coercivity. From the perspective of reducing the coercivity, the Cu content is preferably 0.1 atom % or more.

M1 is at least one of elements selected from Ti, Zr, Hf, Nb, Ta, Mo, V, W, Cr, Al, Mn, and Zn. Preferably, at least one of elements selected from Nb, Zr, and Hf are included.

The M1 content (c) is preferably 15.0 atom % or less (including 0), and more preferably 8 atom % or less (including 0). That is, M1 may not be included. The amorphous parts can be stabilized and the nanocrystal parts can be formed by adding M1 in the above-described range.

The Si content (d) is preferably 17.5 atom % or less (including 0), and more preferably 15.5 atom % or less (including 0). That is, Si may not be included. The composition of the nanocrystal parts can be controlled by setting the Si content to the above-described range.

M2 is at least one of elements selected from B, P, and C. Preferably, at least two of elements selected from B, P, and C are included.

The M2 content (e) is preferably 20.0 atom % or less (including 0), and more preferably 8.0 to 15.0 atom %. That is, M2 may not be included. The composition of the amorphous parts can be controlled by adding M2 in the above-described range.

Furthermore, Fe is preferably a remaining part of the soft magnetic alloy represented by the composition formula $Fe_aCu_bM1_cSi_dM2_e$. That is, a+b+c+d+e=100. In addition, as mentioned above, the soft magnetic alloy of the embodiment includes nanocrystal parts and amorphous parts. Here, at least two of elements selected from M1, M2 and Si are necessary for forming the amorphous parts. Therefore, at least two of c, d and e are not 0.

In addition, the composition of the soft magnetic alloy can also be represented by the composition formula $(Fe_{1-z}X1_z)_a Cu_bM1_cSi_dM2_eM3_f$.

X1 is at least one of elements selected from Co and Ni;

M1 is at least one of elements selected from Ti, Zr, Hf, Nb, Ta, Mo, V, W, Cr, Al, Mn, and Zn;

M2 is at least one of elements selected from B, P, and C;

M3 is at least one of elements selected from S, O, and N; and $$a+b+c+d+e+f=100$$

$0.0 \leq z \leq 0.15$
$64.9 \leq a \leq 94.5$
$0.0 \leq b \leq 3.0$ $0.0 \leq c \leq 15.5$ $0.0 \leq d \leq 17.5$ $2.0 \leq e \leq 23.0$ $0.0 \leq f \leq 3.0$; and at least one of c and d is not 0.

A substitution amount of X1 to Fe (z) may be $0.00 \leq z \leq 0.15$. In addition, M3 is at least one of elements selected from S, O, and N. The M3 content (f) may be 3.0 atom % or less.

Hereinafter, a method for producing the soft magnetic alloy of the embodiment is described.

The method for producing the soft magnetic alloy of the embodiment is arbitrary, and for example the method for producing the ribbon of the soft magnetic alloy by the single-roll method is cited.

In the single-roll method, at first, various raw materials such as a pure metal or the like of each metal element included in the finally obtained soft magnetic alloy are prepared, and are weighed to be the same composition as the finally obtained soft magnetic alloy. Then, the pure metal of each metal element is melted and mixed to make a base alloy. Furthermore, a method for melting the pure metal is arbitrary, for example, there is the method of vacuuming within a chamber and subsequently melting by high frequency heating. Furthermore, the base alloy and the finally obtained soft magnetic alloy usually have the same composition.

Next, the base alloy that is made is heated and melted to obtain a melted metal (molten metal). A temperature of the melted metal is not particularly limited, and can be 1200 to 1500° C. for example.

Figure 3:
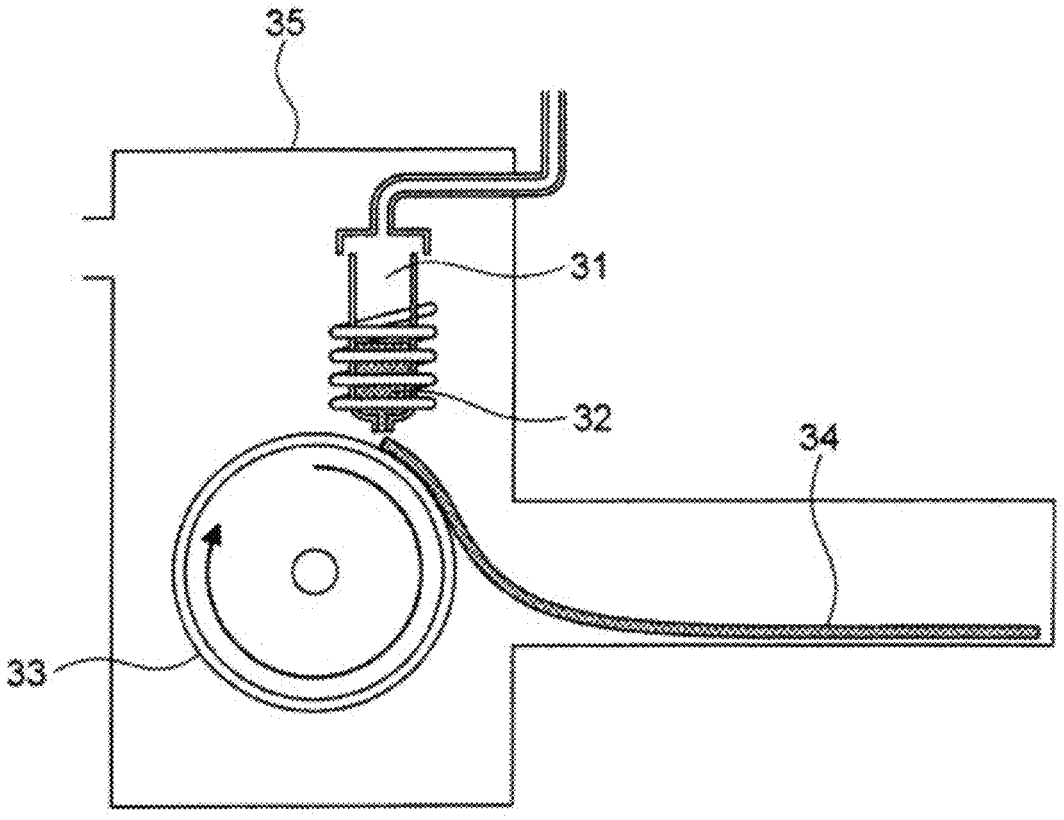
FIG. 3 is a schematic view of a single-roll method.

A schematic diagram of the device used in the single-roll method is shown in FIG. 3. In the single-roll method of the embodiment, inside a chamber 35, a ribbon 34 is produced to a rotation direction of a roll 33 by injecting and providing a melted metal 32 from a nozzle 31 to the roll 33 rotating in a direction of an arrow. Furthermore, in the embodiment, a material of the roll 33 is not particularly limited. For example, a roll made of Cu is used.

In the single-roll method, a thickness of the obtained ribbon can be adjusted mainly by adjusting a rotation speed of the roll 33; however, the thickness of the obtained ribbon can also be adjusted by adjusting, for example, a space between the nozzle 31 and the roll 33 or the temperature of the melted metal or the like. The thickness of the ribbon is not particularly limited, and can be 15 to 30 μm for example.

At a time point before a heat treatment described later, the ribbon is preferably in an amorphous state or a state that only microcrystals with small grain sizes exist. The soft magnetic alloy of the embodiment is obtained by performing the heat treatment described later to this kind of ribbon.

Furthermore, a method for confirming whether there are crystals with great grain sizes in the ribbon of the soft magnetic alloy before the heat treatment is not particularly limited. For example, the existence of crystals with grain sizes of about 0.01 to 10 μm can be confirmed by an ordinary X-ray diffraction measurement. In addition, when there are crystals in the above-described amorphous ribbon but a volume ratio of the crystals is small, a judgment would be made in the ordinary X-ray diffraction measurement that there is no crystal. The existence of the crystals on this occasion can be confirmed, for example, by using a transmission electron microscopy to a sample flaked by ion milling to obtain a selected area electron diffraction image, a nanobeam diffraction image, a bright-field image or a high-resolution image. When the selected area electron diffraction image or the nanobeam diffraction image is used, in the diffraction pattern, a ring-shaped diffraction is formed in the case of being amorphous, whereas diffraction spots caused by a crystal structure are formed in the case of not being amorphous. In addition, when the bright-field image or the high-resolution image is used, the existence of the crystals can be confirmed by observing visually at a magnification of $1.00 \times 10^5$ to $3.00 \times 10^5$. Furthermore, in the specification, when it can be confirmed by the ordinary X-ray diffraction measurement that there are crystals, it is described as "there are crystals", and when it cannot be confirmed in the ordinary X-ray diffraction measurement that there are crystals, but the existence of the crystals can be confirmed by using the transmission electron microscopy to the sample flaked by ion milling to obtain the selected area electron diffraction image, the nanobeam diffraction image, the bright-field image or the high-resolution image, it is described as "there are microcrystals".

Here, the inventors found that, the ribbon of the soft magnetic alloy before the heat treatment is easily made to be amorphous and preferable nanocrystal parts 11 and preferable amorphous parts 13 are obtained easily after the heat treatment by appropriately controlling a temperature of the roll 33 and a vapor pressure inside the chamber 35. Specifically, the inventors found that the ribbon of the soft magnetic alloy can be easily made to be amorphous by setting the temperature of the roll 33 to 50 to 70° C., preferably 70° C., and using Ar gas to which a dew-point adjustment was performed to set the vapor pressure inside the chamber 35 to 11 hPa or lower, preferably 4 hPa or lower.

In addition, preferably, the temperature of the roll 33 is set to 50 to 70° C. and the vapor pressure inside the chamber 35 is further set to 11 hPa or lower. By controlling the temperature of the roll 33 and the vapor pressure inside the chamber 35 to the above-described range, the melted metal 32 is uniformly cooled, and the ribbon before the heat treatment of the obtained soft magnetic alloy can be easily made into uniform amorphous substance. Furthermore, there is no particular lower limit of the vapor pressure inside the chamber. Argon to which the dew-point adjustment was performed may be filled to set the vapor pressure to 1 hPa or lower, or a state close to vacuum may be reached to set the vapor pressure to 1 hPa or lower. In addition, if the vapor pressure becomes higher, the ribbon before the heat treatment is difficult to be made amorphous, and even if the ribbon before the heat treatment is made amorphous, the above-described preferable microstructure is difficult to be obtained after the heat treatment described later.

The preferable nanocrystal parts 11 and the preferable amorphous parts 13 can be obtained by treating the obtained ribbon 34 with heat. At this moment, if the ribbon 34 is completely amorphous, the preferable microstructure is obtained easily.

In the embodiment, the above-described preferable microstructure is obtained easily by carrying out the heat treatment in two stages. The heat treatment of the first stage (hereinafter, also referred to as the first heat treatment) is carried out for so called strain relieving. The reason of carrying out for strain relieving is to make the soft magnetic metal which is as uniform amorphous as possible.

In the embodiment, the heat treatment of the second stage (hereinafter, also referred to as the second heat treatment) is carried out at a temperature higher than the temperature of the heat treatment of the first stage. Besides, in order to suppress self-heating of the ribbon in the heat treatment of the second stage, it is important to use a setter made of a material with a high thermal conductivity. In addition, the material of the setter having a low specific heat is more preferable. Conventionally, alumina is often used as the material of the setter, but in the embodiment, the material having a higher thermal conductivity, for example carbon or SiC or the like, can be used. Specifically, the material having a thermal conductivity 150 W/m or more is preferably used. Furthermore, the material having a specific heat 750 J/kg or less is preferably used. Furthermore, preferably, the thickness of the setter is reduced as much as possible, and a thermocouple for controlling is put under the setter to improve a thermal response of a heater.

Advantages of carrying out the heat treatment by the above-described two stages are described. A function of the heat treatment of the first stage is described. The soft magnetic alloy is rapidly cooled from a high temperature and solidified to be made amorphous. At this moment, because of the rapid cooling from the high temperature, stress caused by thermal contraction remains inside the soft magnetic metal, and strains or defects are generated. The heat treatment of the first stage alleviates the strains or the defects inside the soft magnetic alloy by the heat treatment, thereby forming uniform amorphous substance. Then, a function of the heat treatment of the second stage is described. In the heat treatment of the second stage, the αFe(—Si) crystals are generated. Because the strains or the defects can be suppressed in the heat treatment of the first stage and an evenly amorphous state is formed, grain sizes of the αFe(—Si) crystals generated by the heat treatment of the second stage can be made uniform. That is, even if the heat treatment is carried out at a comparatively low temperature, the αFe(—Si) crystals can be stably generated. Therefore, the heat treatment temperature in the heat treatment of the second stage tends to be comparatively lower than the heat treatment temperature in a conventional case that the heat treatment is carried out in one stage. In other words, in the case that the heat treatment is carried out in one stage, a reaction for forming the αFe(—Si) crystals proceeds antecedently in the strains or defects remained during the forming amorphous substance and in the surroundings of the strains or defects, and the grain sizes of the αFe(—Si) crystals cannot be made uniform. Furthermore, a different phase formed from boride will be formed, and the soft magnetic characteristic will be aggravated. In addition, in order to make the soft magnetic alloy which is as uniform amorphous as possible in the one-stage heat treatment, it is necessary to generate the αFe(—Si) crystals in the entire soft magnetic alloy as simultaneously as possible. Therefore, in the one-stage heat treatment, the heat treatment temperature tends to be higher than the heat treatment temperature of the above-described two-stage heat treatment.

In the embodiment, preferable heat treatment temperatures and preferable heat treatment time of the first heat treatment and the second heat treatment vary with the compositions of the soft magnetic alloy. Generally, the composition including Si tends to have a heat treatment temperature comparatively lower than the composition without Si. The heat treatment temperature of the first heat treatment is approximately 350° C. or more and 550° C. or less, and the heat treatment time is approximately 0.1 hour or more and 10 hours or less. The heat treatment temperature of the second heat treatment is approximately 475° C. or more and 675° C. or less, and the heat treatment time is approximately 0.1 hour or more and 10 hours or less. However, there is also an occasion that the preferable heat treatment temperature and the preferable heat treatment time fall out of the above-described range according to the composition.

when heat treatment conditions are not suitably controlled or when a preferred heat treatment device is not selected, the sub-component are not contained in the nanocrystal parts, the oxidation resistance is reduced, and good soft magnetic characteristics are difficult to obtain.

In addition, as a method for obtaining the soft magnetic alloy of the embodiment, in addition to the single-roll method, there is a method for obtaining powder of the soft magnetic alloy of the embodiment by, for example, a water atomizing method or a gas atomizing method. Hereinafter, the gas atomizing method is described.

In the gas atomizing method, a molten alloy of 1200 to 1500° C. is obtained in the same way as the single-roll method. Thereafter, the molten alloy is injected into the chamber and the powder is made.

At this moment, by setting a gas injection temperature to 50 to 100° C. and the vapor pressure inside the chamber to 4 hPa or lower, finally the above-described preferable microstructure is obtained easily.

After the powder is made by the gas atomizing method, the preferred microstructure is obtained easily by carrying out the heat treatment in two stages in the same way as the case using the single-roll method. Then, the soft magnetic alloy powder having particularly high oxidation resistance and good soft magnetic characteristics can be obtained.

In the above, one embodiment of the present invention is described, but the present invention is not limited to the above-described embodiment.

A shape of the soft magnetic alloy of the embodiment is not particularly limited. As described above, a ribbon shape and a powder shape are exemplified, in addition to this, a thin film shape, a block shape, or the like are also considered.

An application of the soft magnetic alloy of the embodiment is not particularly limited. For example, the application in core is mentioned. The soft magnetic alloy can be suitably used as the core for an inductor, particularly for a power inductor. The soft magnetic alloy of the embodiment can also be suitably used for a thin film inductor, a magnetic head, and a voltage transformer in addition to the core.

Hereinafter, a method for obtaining the core and the inductor from the soft magnetic alloy of the embodiment is described, but the method for obtaining the core and the inductor from the soft magnetic alloy of the embodiment is not limited to the method described below.

As the method for obtaining the core from the ribbon-like soft magnetic alloy, for example, the method in which the ribbon-like soft magnetic alloy is wound or the method in which the ribbon-like soft magnetic alloy is stacked is mentioned. When the ribbon-like soft magnetic alloy is stacked via an insulator, the core having further improved characteristics can be obtained.

As the method for obtaining the core from the powder-like soft magnetic alloy, for example, the method of using a press mold after a mixture with a proper binder for molding is mentioned. In addition, by performing an oxidation treatment or an insulating coating or the like on a powder surface before the mixture with the binder, the core which has an improved specific resistance and which is more suitable for a high frequency band is formed.

A forming method is not particularly limited, and the forming using the press mold or a mold forming or the like is exemplified. A type of the binder is not particularly limited, and a silicone resin is exemplified. A mixture ratio of the soft magnetic alloy powder and the binder is not particularly limited either. For example, 1 to 10 mass % of the binder is mixed with 100 mass % of the soft magnetic alloy powder.

For example, 1 to 5 mass % of the binder is mixed with 100 mass % of the soft magnetic alloy powder and the press mold is used for compression molding, and thereby the core can be obtained in which an occupation ratio (powder filling ratio) is 70% or more, a magnetic flux density at the time of applying a magnetic field of $1.6\times10^4$ A/m is 0.4 T or more, and a specific resistance is 1 Ω·cm or more. The above-described characteristics are characteristics better than a common ferrite core.

In addition, for example, 1 to 3 mass % of the binder is mixed with 100 mass % of the soft magnetic alloy powder, and compression molding is performed by a press mold under a temperature condition above a softening point of the binder, and thereby a dust core can be obtained in which the occupation ratio is 80% or more, the magnetic flux density at the time of applying a magnetic field of $1.6\times10^4$ A/m is 0.9 T or more, and the specific resistance is 0.1 Ω·cm or more. The above-described characteristics are characteristics better than a common dust core.

Furthermore, the core loss is further reduced and the utility of the above-described core is further improved by performing a heat treatment as a strain relieving heat treatment after the molding for a molded body forming the above-described core.

In addition, an inductance component is obtained by subjecting the above-described core to winding. The way of subjecting the core to winding and the method for producing the inductance component are not particularly limited. For example, the method in which the coil is wound for at least one turn on the core produced by the above-described method is mentioned.

Furthermore, when soft magnetic alloy particles are used, there is a method for producing the inductance component by press molding and integrating in a state that a winding coil is built in the magnetic material. On this occasion, an inductance component dealing with high frequency and large current is obtained easily.

Furthermore, when the soft magnetic alloy particles are used, the inductance component can be obtained by alternately printing and stacking a soft magnetic alloy paste and a conductor paste, followed by heating and firing. The soft magnetic alloy paste is obtained by adding a binder and a solvent to the soft magnetic alloy particles and pasting. The conductor paste is obtained by adding a binder and a solvent to a conductor metal for the coil and pasting. Or the soft magnetic alloy paste is used to make soft magnetic alloy sheets and the conductor paste is printed on a surface of the soft magnetic alloy sheets, and the soft magnetic alloy sheets have the conductor paste are stacked and fired, and thereby the inductance component in which the coil is built in the magnetic material can be obtained.

Here, when the soft magnetic alloy particles are used to produce the inductance component, using the soft magnetic alloy powder in which the maximum grain size is 45 μm or less according to a sieve diameter and a median diameter (D50) is 30 μm or less is preferable for obtaining an excellent Q characteristic. In order to set the maximum grain size to 45 μm according to the sieve diameter, a sieve with a mesh of 45 μm may be used and only the soft magnetic alloy powder passing through the sieve is used.

There is a tendency that when the soft magnetic alloy powder with a greater maximum grain size is used, the Q value in the high frequency region decreases, particularly when soft magnetic alloy powder which has a maximum grain size beyond 45 μm according to the sieve diameter is used, the Q value in the high frequency region may reduce greatly. However, when the Q value in the high frequency region is not emphasized, the soft magnetic alloy powder with great deviation of grain size can be used. Because the soft magnetic alloy powder with great deviation of grain size can be produced at a comparatively low cost, when the soft magnetic alloy powder with great deviation of grain size is used, the cost can be reduced.

The application of the dust core of the embodiment is not particularly limited. For example, the dust core can be suitably used as the core for the inductor, particularly for the power inductor.

EXAMPLES

Hereinafter, the present invention is specifically described based on examples.

Experimental Example 1

Various raw material metals and the like are respectively weighed to obtain a base alloy with a composition of Fe: 84 atom %, B: 9.0 atom %, and Nb: 7.0 atom %. Then, after vacuuming inside the chamber, the base alloy is made by melting the various raw material metals by high frequency heating.

Thereafter, the base alloy that is made is heated and melted and a metal at a melting state of 1300° C. is made. Subsequently, the roll temperature is set to 70° C. and the vapor pressure inside the chamber is set to 4 hPa to inject the metal to the roll by the single-roll method to make ribbons. In addition, a thickness of the obtained ribbon is set to 20 μm by appropriately adjusting a rotation number of the roll. The vapor pressure is adjusted by using Ar gas to which the dew-point adjustment is carried out.

Next, the heat treatment is carried out for each ribbon that is made, and samples with single plate shapes are obtained. In the experimental example, the heat treatment is carried out for 2 times for the samples except samples No. 7 to 12. Heat treatment conditions are shown in table 1. In addition, when the heat treatment is carried out for each ribbon, the ribbons are placed on setters of materials disclosed in table 1, and thermocouples for control are placed under the setters. Thicknesses of the setters at this moment are unified to 1 mm. Furthermore, alumina with a thermal conductivity of 31 W/m and a specific heat of 779 J/kg is used. Carbon with a thermal conductivity of 150 W/m and a specific heat of 691 J/kg is used. SiC (silicon carbide) with a thermal conductivity of 180 W/m and a specific heat of 740 J/kg is used.

After one portion of each ribbon before the heat treatment is pulverized and powdered, the X-ray diffraction measurement is carried out to confirm the existence of the crystals. Furthermore, the transmission electron microscopy is used to observe the selected area electron diffraction image and the bright-field image at magnification of 300000 times and confirm the existence of the microcrystal. As a result, it is confirmed that the ribbon of each Example and Comparative Example is amorphous without crystals or microcrystals therein. Furthermore, a confirmation is made by the ICP measurement and the fluorescent X-ray measurement that compositions of all the samples are substantially consonant with the composition of the base alloy.

Then, the saturation magnetic flux density and the coercivity of each sample after each ribbon is treated with heat are measured. Results are shown in table 1. The saturation magnetic flux density (Bs) is measured at a magnetic field of 1000 kA/m using a Vibrating Sample Magnetometer (VSM). The coercivity (Hc) is measured at a magnetic field of 5 kA/m using a direct current BH tracer. In addition, the oxidation resistance is evaluated for each sample. Specifically, a high temperature and humidity resistance test is carried out for 3 hours at a temperature of 80° C. and a humidity of 85%, and the surface is observed to judge whether it is rusted or not. The results are shown in table 1.

Furthermore, a range with an observation range of 40 nm×40 nm×200 nm is observed using the 3DAP (3-dimensional atom probe) for each sample, and it is confirmed that all the samples include nanocrystal parts and amorphous parts. Furthermore, the 3DAP is used to measure the nanocrystal part composition and the amorphous part composition. The results are shown in table 2. Furthermore, the average grain size of the nanocrystals in the nanocrystal parts and the crystallinity degree in the nanocrystal parts are also calculated using the XRD. The results are shown in table 2.

TABLE 1

| | | | Heat treatment conditions | | | | | | |
|---|---|---|---|---|---|---|---|---|---|
| | | | First time | | Second time | | Saturation | | |
| Sample No | Example/ Comparative Example | Setter | Temperature (° C.) | Time (h) | Temperature (° C.) | Time (h) | magnetic flux (T) | Coercivity (A/m) | Oxidation resistance |
| 1 | Comparative Example | Alumina | 450 | 1 | 550 | 1 | 1.20 | 20 | Rusted |
| 2 | Comparative Example | Alumina | 450 | 1 | 575 | 1 | 1.25 | 14 | Rusted |
| 3 | Comparative Example | Alumina | 450 | 1 | 600 | 1 | 1.40 | 10 | Rusted |
| 4 | Comparative Example | Alumina | 450 | 1 | 625 | 1 | 1.43 | 18 | Rusted |
| 5 | Comparative Example | Alumina | 450 | 1 | 650 | 1 | 1.50 | 183 | Rusted |
| 7 | Comparative Example | Carbon | — | — | 550 | 1 | 1.19 | 20 | Rusted |
| 8 | Comparative Example | Carbon | — | — | 575 | 1 | 1.22 | 14 | Rusted |
| 9 | Comparative Example | Carbon | — | — | 600 | 1 | 1.39 | 10 | Rusted |
| 10 | Comparative Example | Carbon | — | — | 625 | 1 | 1.41 | 18 | Rusted |
| 11 | Comparative Example | Carbon | — | — | 650 | 1 | 1.50 | 19 | Rusted |
| 12 | Comparative Example | Carbon | — | — | 675 | 1 | 1.51 | 145 | Rusted |
| 13 | Example | Carbon | 450 | 1 | 550 | 1 | 1.30 | 10 | Not rusted |
| 14 | Example | Carbon | 450 | 1 | 575 | 1 | 1.48 | 7.7 | Not rusted |
| 15 | Example | Carbon | 450 | 1 | 600 | 1 | 1.52 | 4.3 | Not rusted |
| 16 | Example | Carbon | 450 | 1 | 625 | 1 | 1.51 | 3.2 | Not rusted |
| 17 | Example | Carbon | 450 | 1 | 650 | 1 | 1.54 | 2.8 | Not rusted |
| 18 | Example | Carbon | 450 | 1 | 675 | 1 | 1.52 | 4.5 | Not rusted |
| 19 | Comparative Example | Carbon | 450 | 1 | 700 | 1 | 1.53 | 123 | Rusted |
| 20 | Comparative Example | Carbon | 300 | 1 | 650 | 1 | 1.50 | 19 | Rusted |
| 21 | Example | Carbon | 350 | 1 | 650 | 1 | 1.50 | 13 | Not rusted |
| 22 | Example | Carbon | 400 | 1 | 650 | 1 | 1.51 | 3.2 | Not rusted |
| 23 | Example | Carbon | 500 | 1 | 650 | 1 | 1.51 | 3.2 | Not rusted |
| 24 | Example | Carbon | 550 | 1 | 650 | 1 | 1.51 | 4.3 | Not rusted |
| 24a | Comparative Example | Carbon | 600 | 1 | 650 | 1 | 1.34 | 17 | Rusted |
| 25 | Example | Carbon | 450 | 0.1 | 650 | 1 | 1.54 | 3.6 | Not rusted |
| 26 | Example | Carbon | 450 | 0.5 | 650 | 1 | 1.52 | 3.5 | Not rusted |
| 27 | Example | Carbon | 450 | 3 | 650 | 1 | 1.51 | 2.7 | Not rusted |
| 28 | Example | Carbon | 450 | 10 | 650 | 1 | 1.52 | 2.4 | Not rusted |
| 29 | Example | Carbon | 450 | 1 | 650 | 0.1 | 1.51 | 5.2 | Not rusted |
| 30 | Example | Carbon | 450 | 1 | 650 | 0.5 | 1.54 | 3.7 | Not rusted |
| 31 | Example | Carbon | 450 | 1 | 650 | 3 | 1.52 | 2.9 | Not rusted |
| 32 | Example | Carbon | 450 | 1 | 650 | 10 | 1.51 | 2.8 | Not rusted |
| 33 | Example | SiC | 450 | 1 | 550 | 1 | 1.30 | 11 | Not rusted |
| 34 | Example | SiC | 450 | 1 | 575 | 1 | 1.48 | 7.9 | Not rusted |
| 35 | Example | SiC | 450 | 1 | 600 | 1 | 1.52 | 5.6 | Not rusted |
| 36 | Example | SiC | 450 | 1 | 625 | 1 | 1.51 | 2.2 | Not rusted |
| 37 | Example | SiC | 450 | 1 | 650 | 1 | 1.54 | 2.5 | Not rusted |
| 38 | Example | SiC | 450 | 1 | 675 | 1 | 1.52 | 3.8 | Not rusted |
| 39 | Comparative Example | SiC | 450 | 1 | 700 | 1 | 1.53 | 108 | Rusted |

TABLE 2

| | | Nanocrystal part composition (at %) | | | | | Amorphous part composition (at %) | | | | | Sub- | Nanocrystal average | |
|---|---|---|---|---|---|---|---|---|---|---|---|---|---|---|
| Sample No | Example/ Comparative Example | Fe | M1 | M2 | Cu | M1 + M2 + Cu (α) | Fe | M1 | M2 | Cu | M1 + M2 + Cu (α) | component ratio (α)/(β) | grain size (nm) | Crystallinity degree (%) |
| 1 | Comparative Example | 100.0 | 0.0 | 0.0 | 0.0 | 0.0 | 58.6 | 19.4 | 22.0 | 0.0 | 41.4 | 0.00 | 0.2 | 4 |
| 2 | Comparative Example | 100.0 | 0.0 | 0.0 | 0.0 | 0.0 | 57.4 | 19.5 | 23.1 | 0.0 | 42.6 | 0.00 | 5 | 14 |
| 3 | Comparative Example | 100.0 | 0.0 | 0.0 | 0.0 | 0.0 | 58.7 | 19.6 | 21.7 | 0.0 | 41.3 | 0.00 | 8 | 32 |

TABLE 2-continued

| Sample No | Example/ Comparative Example | Nanocrystal part composition (at %) Fe | M1 | M2 | Cu | M1 + M2 + Cu (α) | Amorphous part composition (at %) Fe | M1 | M2 | Cu | M1 + M2 + Cu (α) | Sub-component ratio (α)/(β) | Nanocrystal average grain size (nm) | Crystallinity degree (%) |
|---|---|---|---|---|---|---|---|---|---|---|---|---|---|---|
| 4 | Comparative Example | 100.0 | 0.0 | 0.0 | 0.0 | 0.0 | 58.9 | 19.5 | 21.6 | 0.0 | 41.1 | 0.00 | 7 | 52 |
| 5 | Comparative Example | 100.0 | 0.0 | 0.0 | 0.0 | 0.0 | 58.8 | 19.4 | 21.8 | 0.0 | 41.2 | 0.00 | 8 | 74 |
| 7 | Comparative Example | 100.0 | 0.0 | 0.0 | 0.0 | 0.0 | 64.9 | 17.1 | 18.0 | 0.0 | 35.1 | 0.00 | 1 | 2 |
| 8 | Comparative Example | 100.0 | 0.0 | 0.0 | 0.0 | 0.0 | 63.7 | 17.2 | 19.1 | 0.0 | 36.3 | 0.00 | 4 | 13 |
| 9 | Comparative Example | 100.0 | 0.0 | 0.0 | 0.0 | 0.0 | 63.0 | 17.5 | 19.5 | 0.0 | 37.0 | 0.00 | 5 | 28 |
| 10 | Comparative Example | 100.0 | 0.0 | 0.0 | 0.0 | 0.0 | 61.0 | 18.7 | 20.3 | 0.0 | 39.0 | 0.00 | 7 | 51 |
| 11 | Comparative Example | 100.0 | 0.0 | 0.0 | 0.0 | 0.0 | 58.8 | 19.4 | 21.8 | 0.0 | 41.2 | 0.00 | 8 | 65 |
| 12 | Comparative Example | 100.0 | 0.0 | 0.0 | 0.0 | 0.0 | 58.2 | 19.6 | 22.2 | 0.0 | 41.8 | 0.00 | 8 | 74 |
| 13 | Example | 89.0 | 4.8 | 6.2 | 0.0 | 11.0 | 61.6 | 17.3 | 21.1 | 0.0 | 38.4 | 0.29 | 4 | 15 |
| 14 | Example | 91.7 | 3.8 | 4.5 | 0.0 | 8.3 | 59.2 | 18.3 | 22.5 | 0.0 | 40.8 | 0.20 | 5 | 33 |
| 15 | Example | 93.0 | 3.3 | 3.7 | 0.0 | 7.0 | 58.7 | 19.6 | 21.7 | 0.0 | 41.3 | 0.17 | 7 | 51 |
| 16 | Example | 94.3 | 2.5 | 3.2 | 0.0 | 5.7 | 58.9 | 19.5 | 21.6 | 0.0 | 41.1 | 0.14 | 7 | 58 |
| 17 | Example | 95.2 | 2.3 | 2.5 | 0.0 | 4.8 | 58.8 | 19.4 | 21.8 | 0.0 | 41.2 | 0.12 | 8 | 64 |
| 18 | Example | 98.1 | 0.6 | 1.3 | 0.0 | 1.9 | 59.1 | 19.3 | 21.6 | 0.0 | 40.9 | 0.05 | 7 | 70 |
| 19 | Comparative Example | 100.0 | 0.0 | 0.0 | 0.0 | 0.0 | 58.8 | 19.5 | 21.7 | 0.0 | 41.2 | 0.00 | 8 | 78 |
| 20 | Comparative Example | 100.0 | 0.0 | 0.0 | 0.0 | 0.0 | 58.8 | 19.4 | 21.8 | 0.0 | 41.2 | 0.00 | 7 | 65 |
| 21 | Example | 99.9 | 0.0 | 0.1 | 0.0 | 0.1 | 59.1 | 19.3 | 21.6 | 0.0 | 40.9 | 0.00 | 8 | 58 |
| 22 | Example | 96.0 | 1.8 | 2.2 | 0.0 | 4.0 | 58.9 | 19.6 | 21.5 | 0.0 | 41.1 | 0.10 | 7 | 54 |
| 23 | Example | 97.8 | 0.8 | 1.4 | 0.0 | 2.2 | 59.2 | 19.5 | 21.3 | 0.0 | 40.8 | 0.05 | 7 | 62 |
| 24 | Example | 99.7 | 0.1 | 0.2 | 0.0 | 0.3 | 61.0 | 18.7 | 20.3 | 0.0 | 39.0 | 0.01 | 7 | 70 |
| 24a | Comparative Example | 100.0 | 0.0 | 0.0 | 0.0 | 0.0 | 62.3 | 18.3 | 19.4 | 0.0 | 37.7 | 0.00 | 14 | 65 |
| 25 | Example | 97.9 | 0.9 | 1.2 | 0.0 | 2.1 | 63.2 | 18.2 | 18.6 | 0.0 | 36.8 | 0.06 | 8 | 68 |
| 26 | Example | 95.7 | 1.8 | 2.5 | 0.0 | 4.3 | 59.4 | 19.2 | 21.4 | 0.0 | 40.6 | 0.11 | 8 | 67 |
| 27 | Example | 95.1 | 2.3 | 2.6 | 0.0 | 4.9 | 58.6 | 19.4 | 22.0 | 0.0 | 41.4 | 0.12 | 8 | 61 |
| 28 | Example | 94.9 | 2.4 | 2.7 | 0.0 | 5.1 | 58.2 | 19.6 | 22.2 | 0.0 | 41.8 | 0.12 | 8 | 60 |
| 29 | Example | 94.8 | 2.4 | 2.8 | 0.0 | 5.2 | 66.6 | 15.2 | 18.2 | 0.0 | 33.4 | 0.16 | 8 | 61 |
| 30 | Example | 94.8 | 2.5 | 2.7 | 0.0 | 5.2 | 64.5 | 16.3 | 19.2 | 0.0 | 35.5 | 0.15 | 8 | 62 |
| 31 | Example | 95.7 | 2.0 | 2.3 | 0.0 | 4.3 | 58.6 | 19.3 | 22.1 | 0.0 | 41.4 | 0.10 | 8 | 62 |
| 32 | Example | 96.0 | 1.6 | 2.4 | 0.0 | 4.0 | 59.2 | 19.4 | 21.4 | 0.0 | 40.8 | 0.10 | 8 | 75 |

According to table 1, the results of the oxidation resistance are particularly good in the Examples in which the materials of the setters are carbon or SiC which has a comparatively high thermal conductivity and a comparatively low specific heat, and the heat treatment temperature is carried out at two stages and the first heat treatment temperature and the second heat treatment temperature are appropriately controlled. On the contrary, the results of the oxidation resistance are inferior to the Examples in any one of samples No. 1-5 in which the materials of the setters are alumina which has a comparatively low thermal conductivity and a comparatively high specific heat, samples No. 7-12 in which the heat treatment is carried out at one stage, samples No. 19 and 39 in which the temperature of the second heat treatment is too high, sample No. 20 in which the temperature of the first heat treatment is too low, and sample No. 24a in which the temperature of the first heat treatment is too high.

A fact is seen from table 2 that M1 (Nb) and/or M2 (B) are/is included in the nanocrystal parts in each Example, whereas neither M1 nor M2 is included in the nanocrystal parts in each Comparative Example.

Experimental Example 2

Various raw material metals and the like are respectively weighed to obtain a base alloy with a composition of Fe: 73.5 atom %, Cu: 1.0 atom %, Nb: 3.0 atom %, Si: 13.5 atom %, and B: 9.0 atom %. Then, after vacuuming inside the chamber, the base alloy is made by melting the various raw material metals by high frequency heating. Hereinafter, samples No. 40 to 63 are made in the same way as Experimental Example 1. The results are shown in table 3 and table 4.

Furthermore, the X-ray diffraction measurement is carried out to each ribbon before the heat treatment to confirm the existence of the crystals. Furthermore, the transmission electron microscopy is used to observe the selected area electron diffraction image and the bright-field image at magnification of 300000 times and confirm the existence of the microcrystal. As a result, it is confirmed that the ribbon of each example and comparative example is amorphous and contains neither crystals nor microcrystals. Furthermore, a confirmation is made by the ICP measurement and the fluorescent X-ray measurement that compositions of all the sample are substantially consonant with the composition of the base alloy.

TABLE 3

| Sample No | Example/ Comparative Example | Setter | Heat treatment conditions: First time Temperature (° C.) | First time Time (h) | Second time Temperature (° C.) | Second time Time (h) | Saturation magnetic flux density (T) | Coercivity (A/m) | Oxidation resistance |
|---|---|---|---|---|---|---|---|---|---|
| 40 | Comparative Example | Alumina | 400 | 1 | 475 | 1 | 1.18 | 4.1 | Rusted |
| 41 | Comparative Example | Alumina | 400 | 1 | 500 | 1 | 1.21 | 2.9 | Rusted |
| 42 | Comparative Example | Alumina | 400 | 1 | 525 | 1 | 1.19 | 1.0 | Rusted |
| 43 | Comparative Example | Alumina | 400 | 1 | 550 | 1 | 1.22 | 0.9 | Rusted |
| 44 | Comparative Example | Alumina | 400 | 1 | 575 | 1 | 1.22 | 0.7 | Rusted |
| 45 | Comparative Example | Alumina | 400 | 1 | 600 | 1 | 1.21 | 6.8 | Rusted |
| 46 | Comparative Example | Carbon | — | — | 475 | 1 | 1.18 | 6.2 | Rusted |
| 47 | Comparative Example | Carbon | — | — | 500 | 1 | 1.19 | 3.2 | Rusted |
| 48 | Comparative Example | Carbon | — | — | 525 | 1 | 1.21 | 1.1 | Rusted |
| 49 | Comparative Example | Carbon | — | — | 550 | 1 | 1.22 | 0.8 | Rusted |
| 50 | Comparative Example | Carbon | — | — | 575 | 1 | 1.21 | 0.8 | Rusted |
| 51 | Comparative Example | Carbon | — | — | 600 | 1 | 1.22 | 5.9 | Rusted |
| 52 | Example | Carbon | 400 | 1 | 475 | 1 | 1.21 | 0.6 | Not rusted |
| 53 | Example | Carbon | 400 | 1 | 500 | 1 | 1.20 | 0.4 | Not rusted |
| 54 | Example | Carbon | 400 | 1 | 525 | 1 | 1.22 | 0.3 | Not rusted |
| 55 | Example | Carbon | 400 | 1 | 550 | 1 | 1.19 | 0.5 | Not rusted |
| 56 | Comparative Example | Carbon | 400 | 1 | 575 | 1 | 1.20 | 2.1 | Rusted |
| 57 | Comparative Example | Carbon | 400 | 1 | 600 | 1 | 1.21 | 4.3 | Rusted |
| 58 | Example | SiC | 400 | 1 | 475 | 1 | 1.20 | 0.4 | Not rusted |
| 59 | Example | SiC | 400 | 1 | 500 | 1 | 1.20 | 0.3 | Not rusted |
| 60 | Example | SiC | 400 | 1 | 525 | 1 | 1.21 | 0.3 | Not rusted |
| 61 | Example | SiC | 400 | 1 | 550 | 1 | 1.20 | 0.4 | Not rusted |
| 62 | Comparative Example | SiC | 400 | 1 | 575 | 1 | 1.19 | 0.9 | Rusted |
| 63 | Comparative Example | SiC | 400 | 1 | 600 | 1 | 1.20 | 3.5 | Rusted |

TABLE 4

| Sample No | Example/ Comparative Example | Nanocrystal part composition (at %) Fe | Si | M1 | M2 | Cu | M1 + M2 + Cu (α) | Amorphous part composition (at %) Fe | Si | M1 | M2 | Cu | M1 + M2 + Cu (β) | Sub-component ratio (α)/(β) | Nanocrystal average grain size (nm) | Crystallinity degree (%) |
|---|---|---|---|---|---|---|---|---|---|---|---|---|---|---|---|---|
| 40 | Comparative Example | 88.2 | 11.8 | 0.0 | 0.0 | 0.0 | 0.0 | 71.0 | 7.2 | 5.7 | 16.1 | 0.3 | 21.8 | 0.00 | 0.5 | 5 |
| 41 | Comparative Example | 85.2 | 14.8 | 0.0 | 0.0 | 0.0 | 0.0 | 71.2 | 7.0 | 5.8 | 16.0 | 0.2 | 21.8 | 0.00 | 21 | 15 |
| 42 | Comparative Example | 82.1 | 17.9 | 0.0 | 0.0 | 0.0 | 0.0 | 71.3 | 6.9 | 5.7 | 16.1 | 0.1 | 21.8 | 0.00 | 22 | 28 |
| 43 | Comparative Example | 80.3 | 19.7 | 0.0 | 0.0 | 0.0 | 0.0 | 71.4 | 6.8 | 5.9 | 15.9 | 0.0 | 21.8 | 0.00 | 23 | 52 |
| 44 | Comparative Example | 78.2 | 21.8 | 0.0 | 0.0 | 0.0 | 0.0 | 71.5 | 6.7 | 5.8 | 16.0 | 0.0 | 21.8 | 0.00 | 22 | 70 |
| 45 | Comparative Example | 76.2 | 23.8 | 0.0 | 0.0 | 0.0 | 0.0 | 71.5 | 6.3 | 5.9 | 16.3 | 0.0 | 22.2 | 0.00 | 21 | 78 |
| 46 | Comparative Example | 88.1 | 11.9 | 0.0 | 0.0 | 0.0 | 0.0 | 71.0 | 6.9 | 5.8 | 16.3 | 0.4 | 22.1 | 0.00 | 1.0 | 3 |
| 47 | Comparative Example | 85.3 | 14.7 | 0.0 | 0.0 | 0.0 | 0.0 | 71.2 | 7.0 | 5.6 | 16.2 | 0.3 | 21.8 | 0.00 | 21 | 12 |
| 48 | Comparative Example | 83.2 | 16.8 | 0.0 | 0.0 | 0.0 | 0.0 | 71.1 | 6.8 | 5.8 | 16.3 | 0.2 | 22.1 | 0.00 | 22 | 29 |
| 49 | Comparative Example | 80.5 | 19.5 | 0.0 | 0.0 | 0.0 | 0.0 | 71.2 | 6.6 | 5.9 | 16.3 | 0.0 | 22.2 | 0.00 | 22 | 52 |
| 50 | Comparative Example | 78.4 | 21.6 | 0.0 | 0.0 | 0.0 | 0.0 | 71.4 | 6.4 | 5.8 | 16.4 | 0.0 | 22.2 | 0.00 | 23 | 69 |
| 51 | Comparative Example | 76.4 | 23.6 | 0.0 | 0.0 | 0.0 | 0.0 | 71.5 | 6.5 | 5.8 | 16.2 | 0.0 | 22.0 | 0.00 | 21 | 79 |
| 52 | Example | 74.2 | 17.8 | 2.1 | 5.6 | 0.3 | 8.0 | 73.2 | 12.4 | 4.2 | 10.2 | 0.2 | 14.4 | 0.56 | 5.0 | 5 |
| 53 | Example | 77.3 | 19.1 | 0.8 | 2.5 | 0.3 | 3.6 | 73.2 | 7.1 | 4.8 | 14.9 | 0.1 | 19.7 | 0.18 | 21 | 18 |
| 54 | Example | 79.1 | 18.6 | 0.5 | 1.6 | 0.2 | 2.3 | 71.2 | 8.1 | 5.2 | 15.5 | 0.0 | 20.7 | 0.11 | 22 | 32 |
| 55 | Example | 80.0 | 19.4 | 0.1 | 0.4 | 0.1 | 0.6 | 70.1 | 8.6 | 5.5 | 15.8 | 0.0 | 21.3 | 0.03 | 23 | 58 |
| 56 | Comparative Example | 76.0 | 24.0 | 0.0 | 0.0 | 0.0 | 0.0 | 68.0 | 10.1 | 5.9 | 16.0 | 0.0 | 21.9 | 0.00 | 24 | 73 |
| 57 | Comparative Example | 75.0 | 25.0 | 0.0 | 0.0 | 0.0 | 0.0 | 65.0 | 13.0 | 5.9 | 16.1 | 0.0 | 22.0 | 0.00 | 24 | 81 |
| 58 | Example | 74.1 | 15.2 | 2.5 | 7.9 | 0.3 | 10.7 | 73.2 | 12.6 | 4.1 | 10.1 | 0.5 | 14.2 | 0.75 | 0.7 | 6 |
| 59 | Example | 77.3 | 17.1 | 1.2 | 4.2 | 0.2 | 5.6 | 73.2 | 8.0 | 4.6 | 14.2 | 0.4 | 18.8 | 0.30 | 12 | 12 |
| 60 | Example | 78.5 | 18.7 | 0.6 | 2.2 | 0.0 | 2.8 | 72.1 | 7.8 | 4.8 | 15.3 | 0.3 | 20.1 | 0.14 | 21 | 33 |

TABLE 4-continued

| Sample No | Example/ Comparative Example | Nanocrystal part composition (at %) Fe | Si | M1 | M2 | Cu | M1 + M2 + Cu (α) | Amorphous part composition (at %) Fe | Si | M1 | M2 | Cu | M1 + M2 + Cu (β) | Sub-component ratio (α)/(β) | Nanocrystal average grain size (nm) | Crystallinity degree (%) |
|---|---|---|---|---|---|---|---|---|---|---|---|---|---|---|---|---|
| 61 | Example | 80.0 | 19.7 | 0.0 | 0.2 | 0.1 | 0.3 | 71.3 | 8.0 | 5.2 | 15.5 | 0.0 | 20.7 | 0.01 | 21 | 54 |
| 62 | Comparative Example | 76.2 | 23.8 | 0.0 | 0.0 | 0.0 | 0.0 | 71.1 | 6.8 | 5.8 | 16.3 | 0.0 | 22.1 | 0.00 | 24 | 72 |
| 63 | Comparative Example | 75.8 | 24.2 | 0.0 | 0.0 | 0.0 | 0.0 | 71.2 | 6.7 | 5.8 | 16.3 | 0.0 | 22.1 | 0.00 | 23 | 81 |

According to table 3, the results are particularly good in the Example in which the materials of the setters are carbon or SiC which has a comparatively high thermal conductivity and a comparatively low specific heat, and the heat treatment temperature is carried out at two stages and the first heat treatment temperature and the second heat treatment temperature are appropriately controlled. On the contrary, soft magnetic characteristics and oxidation resistance cannot be compatible and the results are inferior to the Examples in any one of samples No. 40-45 in which the materials of the setters are alumina which has a comparatively low thermal conductivity and a comparatively high specific heat, samples No. 46-51 in which the heat treatment is carried out at one stage, and samples No. 56, 57, 62 and 63 in which the temperature of the second heat treatment is too high.

A fact is seen from table 4 that M1 (Nb), M2 (B) and/or Cu are/is included in the nanocrystal parts in each example, whereas M1, M2 and Cu are not included in the nanocrystal parts in each comparative example.

Experimental Example 3

In Experimental Example 3, the composition of the base alloy is changed to the compositions disclosed in table 5 to table 9. Then, Experimental Example 3 is performed under the same conditions as Experimental Example 1 and Experimental Example 2 until the heat treatment process. Then, differences of the coercivity and the oxidation resistance between the occasions that the heat treatment is performed in one stage and the occasions that the heat treatment is performed in two stages are confirmed. The results are shown in table 5 to table 9. When the heat treatment is performed in one stage, it is performed at 675° C. for 60 minutes. When the heat treatment is performed in two stages, the first heat treatment is performed at 450° C. for 60 minutes, and the second heat treatment is performed at 650° C. for 60 minutes. The heat treatment is carried out under the condition that the material of the setter is set to carbon the same as Experimental Example 1. Furthermore, when the crystals exist in the ribbon before the heat treatment, the coercivity in the one-stage heat treatment increases signally, so that the two-stage heat treatment is not carried out. In addition, for the samples after the two-stage heat treatment, a content (α) of M1+M2+Cu in the nanocrystal parts and a content (β) of M1+M2+Cu in the amorphous parts are measured using the 3DAP. Furthermore, the average grain size of the nanocrystals and the crystallinity degree of the nanocrystal parts are also measured. In addition, as for the oxidation resistance, the high temperature and humidity resistance test is carried out at a temperature of 80° C. and a humidity of 85%, and the surface is observed every 30 minutes to judge whether it is rusted or not. The case in which the time until rust is generated in the two-stage heat treatment is 2.0 times or more long than the time until rust is generated in the one-stage heat treatment is considered as excellent; the case of 1.2 times or more and less than 2.0 times is considered as good; the case of more than 1.0 time and less than 1.2 times is considered as fair; and the case of 1.0 time or less is considered as poor. Furthermore, the excellence degree is arranged in the order of excellent, good, fair, and poor, and in the experimental example, the cases having an evaluation excellent, good, or fair are considered as acceptable.

TABLE 5

| Sample No | Example/ Comparative Example | Composition | Existence of crystal before heat treatment | One-stage heat treatment Coercivity (A/m) | Two-stage heat treatment Coercivity (A/m) | Oxidation resistance | Nano-crystal M1 + M2 + Cu (α) (at %) | Armor-phous M1 + M2 + Cu (β) (at %) | Sub-com-ponent ratio (α)/(β) | Nano-crystal average grain size (nm) | Crystal-linity degree (%) |
|---|---|---|---|---|---|---|---|---|---|---|---|
| 64 | Comparative Example | Fe88Nb3B9 | Crystal | 15000 | — | — | — | — | — | — | — |
| 65 | Example | Fe86Nb5B9 | Armorphous | 16.0 | 11.1 | Good | 4.8 | 39.2 | 0.12 | 10 | 58 |
| 66 | Example | Fe84Nb7B9 | Armorphous | 7.2 | 5.0 | Excellent | 5.6 | 40.0 | 0.14 | 8 | 64 |
| 67 | Example | Fe81Nb10B9 | Armorphous | 7.0 | 4.9 | Excellent | 6.7 | 40.3 | 0.17 | 7 | 59 |
| 68 | Example | Fe77Nb14B9 | Armorphous | 6.2 | 4.3 | Excellent | 8.1 | 40.2 | 0.20 | 21 | 56 |
| 69 | Comparative Example | Fe90Nb7B3 | Crystal | 20000 | — | — | — | — | — | — | — |
| 70 | Example | Fe87Nb7B6 | Armorphous | 12.4 | 8.6 | Good | 4.3 | 37.8 | 0.11 | 8 | 49 |
| 71 | Example | Fe84Nb7B9 | Armorphous | 7.2 | 5.0 | Excellet | 5.1 | 36.4 | 0.14 | 7 | 57 |
| 72 | Example | Fe81Nb7B12 | Armorphous | 6.4 | 4.4 | Excellent | 6.3 | 37.9 | 0.17 | 10 | 54 |
| 73 | Example | Fe75Nb7B18 | Armorphous | 5.1 | 3.5 | Excellent | 8.9 | 46.8 | 0.19 | 18 | 51 |
| 74 | Example | Fe84Nb7B9 | Armorphous | 7.2 | 5.0 | Excellent | 5.2 | 37.1 | 0.14 | 7 | 57 |

TABLE 5-continued

| Sample No | Example/ Comparative Example | Composition | Existence of crystal before heat treatment | One-stage heat treatment Coercivity (A/m) | Two-stage heat treatment Coercivity (A/m) | Oxidation resistance | Nano-crystal M1 + M2 + Cu (α) (at %) | Armor-phous M1 + M2 + Cu (β) (at %) | Sub-com-ponent ratio (α)/(β) | Nano-crystal average grain size (nm) | Crystal-linity degree (%) |
|---|---|---|---|---|---|---|---|---|---|---|---|
| 75 | Example | Fe83.9Cu0.1Nb7B9 | Armorphous | 5.1 | 3.5 | Excellent | 5.3 | 37.9 | 0.14 | 6 | 56 |
| 76 | Example | Fe83Cu2Nb7B9 | Armorphous | 4.8 | 3.3 | Excellent | 5.3 | 37.9 | 0.14 | 5 | 59 |
| 77 | Comparative Example | Fe81Cu3Nb7B9 | Crystal | 18000 | — | — | — | — | — | — | — |
| 78 | Example | Fe85.9Cu0.1Nb5B9 | Microcrystal | 25.0 | 13.2 | Excellent | 5.6 | 40.1 | 0.14 | 6 | 73 |
| 79 | Example | Fe83.9Cu0.1Nb7B9 | Armorphous | 5.1 | 3.5 | Excellent | 5.4 | 38.6 | 0.14 | 5 | 56 |
| 80 | Example | Fe80.9Cu0.1Nb10B9 | Armorphous | 4.8 | 3.3 | Excellent | 6.4 | 38.5 | 0.17 | 7 | 59 |
| 81 | Example | Fe76.9Cu0.1Nb14B9 | Armorphous | 6.2 | 4.3 | Excellent | 8.1 | 40.2 | 0.20 | 6 | 67 |
| 82 | Comparative Example | Fe89.9Cu0.1Nb7B3 | Crystal | 16000 | — | — | — | — | — | — | — |
| 83 | Example | Fe88.4Cu0.1Nb7B4.5 | Armorphous | 12.9 | 8.9 | Good | 4.2 | 41.7 | 0.10 | 6 | 56 |
| 84 | Example | Fe83.9Cu0.1Nb7B9 | Armorphous | 5.1 | 3.5 | Excellent | 5.3 | 37.9 | 0.14 | 6 | 56 |
| 85 | Example | Fe80.9Cu0.1Nb7B12 | Armorphous | 8.2 | 5.7 | Excellent | 6.3 | 37.9 | 0.17 | 7 | 52 |
| 86 | Example | Fe74.9Cu0.1Nb7B18 | Armorphous | 10.1 | 7.0 | Excellent | 8.4 | 38.4 | 0.22 | 6 | 65 |

TABLE 6

| Sample No | Example/ Comparative Example | Composition | Existence of crystal before heat treatment | One-stage heat treatment Coercivity (A/m) | Two-stage heat treatment Coercivity (A/m) | Oxidation resistance | Nano-crystal M1 + M2 + Cu (α) (at %) | Armor-phous M1 + M2 + Cu (β) (at %) | Sub-com-ponent ratio (α)/(β) | Nano-crystal average grain size (nm) | Crystal-linity degree (%) |
|---|---|---|---|---|---|---|---|---|---|---|---|
| 87 | Example | Fe91Zr7B2 | Armorphous | 8.8 | 6.1 | Good | 3.8 | 48.3 | 0.08 | 8 | 57 |
| 88 | Example | Fe90Zr7B3 | Armorphous | 4.8 | 3.3 | Good | 3.6 | 41.1 | 0.09 | 7 | 55 |
| 89 | Example | Fe89Zr7B3Cu1 | Armorphous | 5.3 | 3.7 | Good | 3.6 | 41.1 | 0.09 | 6 | 56 |
| 90 | Example | Fe90Hf7B3 | Armorphous | 6.6 | 4.6 | Good | 3.3 | 37.7 | 0.09 | 7 | 56 |
| 91 | Example | Fe89Hf7B4 | Armorphous | 5.1 | 3.5 | Good | 3.7 | 38.4 | 0.10 | 8 | 55 |
| 92 | Example | Fe88Hf7B3Cu1 | Armorphous | 3.5 | 2.4 | Good | 3.6 | 41.1 | 0.09 | 6 | 58 |
| 93 | Example | Fe84Nb3.5Zr3.5B8Cu1 | Armorphous | 1.8 | 1.3 | Excellent | 5.3 | 40.4 | 0.13 | 6 | 55 |
| 94 | Example | Fe84Nb3.5Hf3.5B8Cu1 | Armorphous | 1.4 | 1.0 | Excellent | 5.4 | 41.1 | 0.13 | 6 | 55 |
| 95 | Example | Fe90.9Nb6B3Cu0.1 | Armorphous | 7.7 | 5.3 | Good | 3.7 | 47.0 | 0.08 | 7 | 56 |
| 96 | Example | Fe84Nb3.5Ti3.5B8Cu1 | Armorphous | 7.8 | 5.2 | Good | 5.2 | 39.6 | 0.13 | 6 | 57 |
| 97 | Example | Fe84Nb3.5Ta3.5B8Cu1 | Armorphous | 8.6 | 5.3 | Good | 5.4 | 41.1 | 0.13 | 6 | 56 |
| 98 | Example | Fe84Nb3.5Mo3.5B8Cu1 | Armorphous | 9.3 | 5.8 | Excellent | 5.8 | 44.2 | 0.13 | 6 | 57 |
| 99 | Example | Fe84Nb3.5W3.5B8Cu1 | Armorphous | 9.5 | 5.3 | Excellent | 5.4 | 41.1 | 0.13 | 6 | 58 |
| 100 | Example | Fe84Nb3.5Al3.5B8Cu1 | Armorphous | 8.9 | 5.8 | Excellent | 5.4 | 41.1 | 0.13 | 6 | 57 |
| 101 | Example | Fe93.06Nb2.97B2.97C1 | Armorphous | 6.2 | 4.3 | Good | 2.4 | 45.7 | 0.05 | 9 | 57 |
| 102 | Example | Fe94.05Nb1.98B2.97C1 | Armorphous | 6.4 | 4.4 | Good | 1.7 | 38.9 | 0.04 | 9 | 57 |
| 103 | Example | Fe90.9Nb1.98B2.97C4 | Armorphous | 4.0 | 2.8 | Good | 2.2 | 41.9 | 0.05 | 8 | 55 |
| 104 | Example | Fe90.9Nb3B6C0.1 | Armorphous | 7.5 | 5.2 | Good | 3.2 | 40.6 | 0.08 | 9 | 54 |
| 105 | Example | Fe94.5Nb3B2C0.5 | Armorphous | 6.2 | 4.3 | Good | 1.8 | 41.1 | 0.04 | 9 | 58 |
| 106 | Example | Fe83.9Nb7B9C0.1 | Armorphous | 4.7 | 3.2 | Excellent | 5.5 | 39.3 | 0.14 | 8 | 59 |
| 107 | Example | Fe80.8Nb6.7B8.65C3.85 | Armorphous | 3.6 | 2.5 | Excellent | 5.4 | 41.1 | 0.13 | 8 | 60 |
| 108 | Example | Fe77.9Nb14B8C0.1 | Armorphous | 9.9 | 6.8 | Excellent | 7.3 | 37.9 | 0.19 | 14 | 52 |
| 109 | Example | Fe75Nb13.5B7.5C4 | Armorphous | 4.2 | 2.9 | Good | 7.4 | 38.4 | 0.19 | 14 | 59 |
| 110 | Example | Fe78Nb1B17C4 | Armorphous | 14.6 | 10.1 | Excellent | 6.1 | 38.7 | 0.16 | 30 | 61 |
| 111 | Example | Fe78Nb1B20C1 | Armorphous | 13.4 | 9.3 | Excellent | 7.4 | 40.3 | 0.18 | 28 | 64 |
| 112 | Example | Fe86.6Nb3.2B10Cu0.1C0.1 | Armorphous | 1.4 | 1.0 | Good | 4.5 | 39.0 | 0.12 | 23 | 55 |
| 113 | Example | Fe75.8Nb14B10Cu0.1C0.1 | Armorphous | 1.6 | 1.1 | Excellent | 8.2 | 45.6 | 0.18 | 14 | 56 |
| 114 | Example | Fe89.8Nb7B3Cu0.1C0.1 | Armorphous | 1.3 | 0.9 | Good | 3.3 | 37.7 | 0.09 | 8 | 63 |
| 115 | Example | Fe72.8Nb7B20Cu0.1C0.1 | Armorphous | 1.8 | 1.2 | Excellent | 9.3 | 46.5 | 0.20 | 14 | 55 |
| 116 | Example | Fe80.8Nb3.2B10Cu3C3 | Armorphous | 2.0 | 1.4 | Good | 4.8 | 41.6 | 0.12 | 16 | 52 |
| 117 | Example | Fe70Nb14B10Cu3C3 | Armorphous | 2.1 | 1.5 | Excellent | 7.1 | 33.8 | 0.21 | 14 | 51 |
| 118 | Example | Fe84Nb7B3Cu3C3 | Armorphous | 2.0 | 1.4 | Good | 2.1 | 24.0 | 0.09 | 8 | 57 |
| 119 | Example | Fe67Nb7B20Cu3C3 | Armorphous | 2.2 | 1.5 | Excellent | 10.5 | 52.5 | 0.20 | 12 | 46 |
| 120 | Example | Fe85Nb3B10Cu1C1 | Armorphous | 2.7 | 1.9 | Good | 4.9 | 43.1 | 0.11 | 7 | 64 |
| 121 | Example | Fe84.8Nb3.2B10Cu1C1 | Armorphous | 1.3 | 0.9 | Good | 4.9 | 43.1 | 0.11 | 13 | 59 |
| 122 | Example | Fe83Nb5B10Cu1C1 | Armorphous | 1.4 | 1.0 | Excellent | 5.3 | 40.4 | 0.13 | 12 | 58 |
| 123 | Example | Fe81Nb7B10Cu1C1 | Armorphous | 1.4 | 1.0 | Excellent | 5.8 | 39.0 | 0.15 | 7 | 59 |
| 124 | Example | Fe78Nb10B10Cu1C1 | Armorphous | 1.5 | 1.1 | Excellent | 6.0 | 34.3 | 0.18 | 8 | 57 |
| 125 | Example | Fe76Nb12B10Cu1C1 | Armorphous | 1.8 | 1.2 | Excellent | 7.2 | 37.4 | 0.19 | 8 | 55 |
| 126 | Example | Fe74Nb14B10Cu1C1 | Armorphous | 1.8 | 1.2 | Excellent | 8.3 | 41.5 | 0.20 | 9 | 56 |

TABLE 7

| Sample No | Example/ Comparative Example | Composition | Existence of crystal before heat treatment | One-stage heat treatment Coercivity (A/m) | Two-stage heat treatment Coercivity (A/m) | Oxidation resistance | Nano-crystal part M1 + M2 + Cu (α) (at %) | Armor-phous part M1 + M2 + Cu (β) (at %) | Sub-com-ponent ratio (α)/(β) | Nano-crystal average grain size (nm) | Crystal-linity degree (%) |
|---|---|---|---|---|---|---|---|---|---|---|---|
| 127 | Example | Fe75.8Nb14B10Cr0.1Cu0.1 | Armorphous | 2.9 | 2.0 | Excellent | 8.6 | 43.0 | 0.20 | 8 | 47 |
| 128 | Example | Fe82.8Nb7B10Cr0.1Cu0.1 | Armorphous | 2.6 | 1.8 | Excellent | 5.8 | 39.0 | 0.15 | 7 | 56 |
| 129 | Example | Fe86.8Nb3B10Cr0.1Cu0.1 | Armorphous | 2.6 | 1.8 | Good | 4.4 | 38.7 | 0.11 | 14 | 56 |
| 130 | Example | Fe72.8Nb7B20Cr0.1Cu0.1 | Armorphous | 3.2 | 2.2 | Excellent | 9.6 | 40.6 | 0.24 | 6 | 48 |
| 131 | Example | Fe89.8Nb7B3Cr0.1Cu0.1 | Armorphous | 2.5 | 1.7 | Good | 3.5 | 40.0 | 0.09 | 5 | 58 |
| 132 | Example | Fe73Nb14B10Cr1.5Cu1.5 | Armorphous | 2.9 | 2.0 | Excellent | 9.2 | 46.0 | 0.20 | 15 | 52 |
| 133 | Example | Fe80Nb7B10Cr1.5Cu1.5 | Armorphous | 2.7 | 1.9 | Excellent | 6.4 | 39.5 | 0.16 | 10 | 54 |
| 134 | Example | Fe84Nb3B10Cr1.5Cu1.5 | Armorphous | 2.7 | 1.9 | Good | 4.7 | 41.3 | 0.11 | 8 | 54 |
| 135 | Example | Fe70Nb7B20Cr1.5Cu1.5 | Armorphous | 3.3 | 2.3 | Excellent | 9.3 | 48.9 | 0.19 | 8 | 52 |
| 136 | Example | Fe87Nb7B3Cr1.5Cu1.5 | Armorphous | 2.6 | 1.8 | Excellent | 4.9 | 48.7 | 0.10 | 7 | 64 |
| 137 | Example | Fe72Nb11B14Cr1Cu2 | Armorphous | 3.4 | 2.3 | Excellent | 10.6 | 46.6 | 0.23 | 13 | 64 |
| 138 | Example | Fe73Nb10B14Cr1Cu2 | Armorphous | 2.7 | 1.9 | Excellent | 8.4 | 44.2 | 0.19 | 13 | 61 |
| 139 | Example | Fe90Nb5B3.5Cr0.5Cu1 | Armorphous | 2.7 | 1.9 | Good | 3.2 | 40.8 | 0.08 | 6 | 58 |
| 140 | Example | Fe91Nb4.5B3Cr0.5Cu1 | Armorphous | 3.3 | 2.3 | Good | 2.8 | 40.0 | 0.07 | 8 | 61 |
| 141 | Example | Fe74.5Nb148B10Cr0.5Cu1 | Armorphous | 2.8 | 1.9 | Excellent | 8.5 | 40.5 | 0.21 | 12 | 58 |
| 142 | Example | Fe76.5Nb12B10Cr0.5Cu1 | Armorphous | 2.5 | 1.7 | Excellent | 7.8 | 40.5 | 0.19 | 11 | 54 |
| 143 | Example | Fe78.5Nb10B10Cr0.5Cu1 | Armorphous | 2.5 | 1.7 | Excellent | 7.3 | 41.7 | 0.18 | 13 | 52 |
| 144 | Example | Fe81.5Nb7B10Cr0.5Cu1 | Armorphous | 2.3 | 1.6 | Excellent | 5.3 | 35.6 | 0.15 | 14 | 53 |
| 145 | Example | Fe83.5Nb5B10Cr0.5Cu1 | Armorphous | 2.3 | 1.6 | Excellent | 5.5 | 41.9 | 0.13 | 12 | 51 |
| 146 | Example | Fe85.5Nb3B10Cr0.5Cu1 | Armorphous | 2.3 | 1.6 | Excellent | 4.8 | 42.2 | 0.11 | 15 | 54 |
| 147 | Example | Fe82.9Nb7B10P0.1 | Armorphous | 1.6 | 1.1 | Excellent | 5.8 | 39.0 | 0.15 | 8 | 58 |
| 148 | Example | Fe82Nb7B10P1 | Armorphous | 1.6 | 1.1 | Excellent | 5.6 | 37.6 | 0.15 | 8 | 53 |
| 149 | Example | Fe80Nb7B10P3 | Armorphous | 1.7 | 1.2 | Excellent | 6.2 | 39.4 | 0.16 | 8 | 54 |
| 150 | Example | Fe78Nb7B10P5 | Armorphous | 1.8 | 1.3 | Excellent | 6.3 | 37.9 | 0.17 | 8 | 56 |
| 151 | Example | Fe81Nb7B10P3Cu1C1 | Armorphous | 2.0 | 1.4 | Excellent | 6.8 | 43.2 | 0.16 | 12 | 57 |
| 152 | Example | Fe75Nb7B10P8 | Armorphous | 2.7 | 1.9 | Excellent | 7.8 | 41.5 | 0.19 | 14 | 58 |
| 153 | Example | Fe93.7Nb3.2B3P0.1 | Armorphous | 1.3 | 0.9 | Good | 2.1 | 38.1 | 0.06 | 7 | 67 |
| 154 | Example | Fe74.9Nb12B13P0.1 | Armorphous | 1.7 | 1.2 | Excellent | 8.7 | 39.5 | 0.22 | 12 | 53 |
| 155 | Example | Fe91Nb3.2B13P3 | Armorphous | 1.9 | 1.3 | Excellent | 5.3 | 37.4 | 0.14 | 7 | 65 |
| 156 | Example | Fe73Nb14B10P3 | Armorphous | 2.0 | 1.4 | Excellent | 9.4 | 49.5 | 0.19 | 18 | 53 |

TABLE 8

| Sample No | Example/ Comparative Example | Composition | Existence of crystal before heat treatment | One-stage heat treatment Coercivity (A/m) | Two-stage heat treatment Coercivity (A/m) | Oxidation resistance | Nano-crystal part M1 + M2 + Cu (α) (at %) | Armor-phous part M1 + M2 + Cu (β) (at %) | Sub-com-ponent ratio (α)/(β) | Nano-crystal average grain size (nm) | Crystal-linity degree (%) |
|---|---|---|---|---|---|---|---|---|---|---|---|
| 157 | Example | Fe81.9Nb7B10P0.1C1 | Armorphous | 1.4 | 1.0 | Good | 5.7 | 38.3 | 0.15 | 8 | 57 |
| 158 | Example | Fe81.5Nb7B10P0.5C1 | Armorphous | 1.4 | 1.0 | Excellent | 6.3 | 40.9 | 0.15 | 7 | 58 |
| 159 | Example | Fe81.5Zr7B10P0.5C1 | Armorphous | 1.6 | 1.1 | Good | 5.8 | 37.9 | 0.15 | 8 | 57 |
| 160 | Example | Fe81.5Hf7B10P0.5C1 | Armorphous | 1.6 | 1.1 | Good | 6.2 | 40.5 | 0.15 | 8 | 56 |
| 161 | Example | Fe81Nb7B10P1C1 | Armorphous | 1.5 | 1.1 | Good | 6.1 | 38.7 | 0.16 | 8 | 56 |
| 162 | Example | Fe80Nb7B10P2C1 | Armorphous | 1.6 | 1.1 | Excellent | 6.4 | 38.5 | 0.17 | 8 | 58 |
| 163 | Example | Fe79Nb7B10P3C1 | Armorphous | 1.8 | 1.3 | Excellent | 7.4 | 40.3 | 0.18 | 8 | 62 |
| 164 | Example | Fe78Nb7B10P4C1 | Armorphous | 2.5 | 1.7 | Excellent | 8.5 | 50.0 | 0.17 | 8 | 63 |
| 165 | Example | Fe93.8Nb3.2B2.8P0.1C0.1 | Armorphous | 1.2 | 0.8 | Good | 2.1 | 38.7 | 0.05 | 7 | 67 |
| 166 | Example | Fe72.9Nb12B13P0.1C2 | Armorphous | 1.5 | 1.1 | Excellent | 9.5 | 39.9 | 0.24 | 10 | 53 |
| 167 | Example | Fe90.9Nb3.2B13P3C0.1 | Armorphous | 1.7 | 1.2 | Good | 6.4 | 38.5 | 0.17 | 7 | 65 |
| 168 | Example | Fe70Nb14B10P3C2 | Armorphous | 1.8 | 1.3 | Excellent | 11.5 | 45.3 | 0.25 | 8 | 53 |
| 169 | Example | Fe80.9Nb7B10P0.1Cu1 | Armorphous | 1.7 | 1.2 | Good | 5.8 | 39.0 | 0.15 | 6 | 63 |
| 170 | Example | Fe81.5Nb7B10P0.5Cu1 | Armorphous | 1.7 | 1.2 | Excellent | 7.3 | 47.7 | 0.15 | 6 | 58 |
| 171 | Example | Fe81Nb7B10P1Cu1 | Armorphous | 1.9 | 1.3 | Excellent | 6.9 | 43.8 | 0.16 | 6 | 57 |
| 172 | Example | Fe80Nb7B10P2Cu1 | Armorphous | 2.0 | 1.4 | Excellent | 6.8 | 40.9 | 0.17 | 6 | 56 |
| 173 | Example | Fe79Nb7B10P3Cu1 | Armorphous | 2.3 | 1.6 | Excellent | 8.0 | 45.7 | 0.18 | 6 | 55 |
| 174 | Example | Fe78Nb7B10P4Cu1 | Armorphous | 3.0 | 2.1 | Excellent | 7.9 | 42.0 | 0.19 | 7 | 58 |
| 175 | Example | Fe93.8Nb3.2B2.8P0.1Cu0.1 | Armorphous | 1.5 | 1.0 | Good | 2.7 | 51.4 | 0.05 | 7 | 68 |
| 176 | Example | Fe73.4Nb12B13P0.1Cul.5 | Armorphous | 1.9 | 1.3 | Excellent | 8.7 | 39.8 | 0.22 | 6 | 58 |
| 177 | Example | Fe90.9Nb3.2B13P3Cu0.1 | Armorphous | 2.1 | 1.5 | Excellent | 9.6 | 57.7 | 0.17 | 7 | 64 |
| 178 | Example | Fe70.5Nb14B10P3Cul.5 | Armorphous | 2.3 | 1.6 | Excellent | 12.3 | 52.1 | 0.24 | 7 | 58 |

TABLE 9

| Sample No | Example/ Comparative Example | Composition | Existence of crystal before heat treatment | One-stage heat treatment Coercivity (A/m) | Two-stage heat treatment Coercivity (A/m) | Two-stage heat treatment Oxidation resistance | Two-stage heat treatment Nanocrystal part M1 + M2 + Cu (α) (at %) | Two-stage heat treatment Armorphous part M1+ M2+ Cu (β) | Two-stage heat treatment Sub-component ratio (α)/(β) | Two-stage heat treatment Nanocrystal average grain size (nm) | Two-stage heat treatment Crystallinity degree (%) |
|---|---|---|---|---|---|---|---|---|---|---|---|
| 179 | Example | Fe80.9Nb7B10P0.1Cu1C1 | Armorphous | 1.5 | 1.1 | Excellent | 6.6 | 44.4 | 0.15 | 7 | 63 |
| 180 | Example | Fe80.5Nb7B10P0.5Cu1C1 | Armorphous | 1.5 | 1.1 | Excellent | 6.9 | 46.4 | 0.15 | 6 | 58 |
| 181 | Example | Fe80Nb7B10P1Cu1C1 | Armorphous | 1.6 | 1.1 | Excellent | 7.3 | 43.9 | 0.17 | 7 | 57 |
| 182 | Example | Fe79Nb7B10P2Cu1C1 | Armorphous | 1.8 | 1.2 | Excellent | 7.4 | 42.3 | 0.18 | 7 | 56 |
| 183 | Example | Fe78Nb7B10P3Cu1C1 | Armorphous | 2.0 | 1.4 | Excellent | 8.9 | 48.4 | 0.18 | 7 | 55 |
| 184 | Example | Fe77.5Nb7B10P3.5Cu1C1 | Armorphous | 2.1 | 1.4 | Excellent | 7.6 | 40.4 | 0.19 | 7 | 46 |
| 185 | Example | Fe93.7Nb3.2B2.8P0.1Cu0.1C0.1 | Armorphous | 1.3 | 0.9 | Fair | 1.9 | 41.0 | 0.05 | 7 | 55 |
| 186 | Example | Fe71.4Nb12B13P0.1Cu1.5C2 | Armorphous | 1.6 | 1.1 | Excellent | 13.2 | 55.9 | 0.24 | 6 | 56 |
| 187 | Example | Fe90.8Nb3.2B2.8P3Cu0.1C0.1 | Armorphous | 1.9 | 1.3 | Good | 4.1 | 52.1 | 0.08 | 7 | 59 |
| 188 | Example | Fe68.5Nb12B13P3Cu1.5C2 | Armorphous | 2.0 | 1.4 | Excellent | 10.4 | 44.0 | 0.24 | 7 | 47 |
| 189 | Example | Fe81.4Nb7B10Cr0.5P0.1Cu1 | Armorphous | 1.8 | 1.3 | Excellent | 7.2 | 46.2 | 0.16 | 8 | 57 |
| 190 | Example | Fe81Nb7B10Cr0.5P0.5Cu1 | Armorphous | 1.8 | 1.3 | Excellent | 6.3 | 42.4 | 0.15 | 9 | 58 |
| 191 | Example | Fe80.5Nb7B10Cr0.5P1Cu1 | Armorphous | 2.0 | 1.4 | Excellent | 6.4 | 43.0 | 0.15 | 8 | 57 |
| 192 | Example | Fe79.5Nb7B10Cr0.5P2Cu1 | Armorphous | 2.1 | 1.5 | Excellent | 6.7 | 43.8 | 0.15 | 7 | 56 |
| 193 | Example | Fe78.5Nb7B10Cr0.5P3Cu1 | Armorphous | 2.4 | 1.7 | Excellent | 7.3 | 41.7 | 0.18 | 8 | 53 |
| 194 | Example | Fe78Nb7B10P3.5Cr0.5Cu1 | Armorphous | 5.0 | 3.5 | Excellent | 7.3 | 40.7 | 0.18 | 7 | 53 |
| 195 | Example | Fe93.7Nb3.2B2.8Cr0.1P0.1Cu0.1 | Armorphous | 1.5 | 1.1 | Good | 2.1 | 38.1 | 0.06 | 8 | 55 |
| 196 | Example | Fe71.9Nb12B13Cr1.5P0.1Cu1.5 | Armorphous | 2.0 | 1.4 | Excellent | 9.8 | 43.9 | 0.22 | 7 | 56 |
| 197 | Example | Fe90.8Nb3.2B2.8Cr0.1P3Cu0.1 | Armorphous | 2.2 | 1.6 | Good | 3.2 | 40.6 | 0.08 | 7 | 59 |
| 198 | Example | Fe69Nb12B13Cr1.5P3Cu1.5 | Armorphous | 2.4 | 1.7 | Excellent | 9.5 | 38.8 | 0.25 | 12 | 45 |
| 199 | Example | Fe80.4Nb7B10Cr0.5P0.1Cu1C1 | Armorphous | 1.6 | 1.1 | Excellent | 5.7 | 38.3 | 0.15 | 9 | 58 |
| 200 | Example | Fe80Nb7B10Cr0.5P0.5Cu1C1 | Armorphous | 1.6 | 1.1 | Excellent | 6.9 | 41.5 | 0.17 | 9 | 57 |
| 201 | Example | Fe79.5Nb7B10Cr0.5P1Cu1C1 | Armorphous | 1.8 | 1.2 | Excellent | 6.4 | 38.5 | 0.17 | 9 | 56 |
| 202 | Example | Fe78.5Nb7B10Cr0.5P2Cu1C1 | Armorphous | 1.9 | 1.3 | Excellent | 6.3 | 42.4 | 0.15 | 9 | 55 |
| 203 | Example | Fe77.5Nb7B10Cr0.5P3Cu1C1 | Armorphous | 2.1 | 1.5 | Excellent | 6.1 | 38.7 | 0.16 | 8 | 52 |
| 204 | Example | Fe77Nb7B10P3.5Cr0.5Cu1C1 | Armorphous | 4.5 | 3.1 | Excellent | 7.9 | 41.0 | 0.19 | 9 | 45 |
| 205 | Example | Fe93.6Nb3.2B2.8Cr0.1P0.1Cu0.1C0.1 | Armorphous | 1.4 | 1.0 | Good | 2.5 | 46.1 | 0.05 | 8 | 55 |
| 206 | Example | Fe69.9Nb12B13Cr1.5P0.1Cu1.5C2 | Armorphous | 1.8 | 1.2 | Excellent | 10.3 | 43.6 | 0.24 | 9 | 56 |
| 207 | Example | Fe90.7Nb3.2B2.8Cr0.1P3Cu0.1C0.1 | Armorphous | 2.0 | 1.4 | Good | 3.3 | 41.9 | 0.08 | 14 | 59 |
| 208 | Example | Fe67Nb12B13Cr1.5P3Cu1.5C2 | Armorphous | 2.1 | 1.5 | Excellent | 10.4 | 42.4 | 0.25 | 13 | 47 |

In each Example, even if the composition is properly changed, when the heat treatment is carried out in two stages, compared with the occasion that the heat treatment is carried out in one stage, the coercivity is signally reduced and the oxidation resistance is improved. In addition, when the heat treatment is carried out in two stages, there are M1, M2 and/or Cu in the nanocrystal parts.

Experimental Example 4

In Experimental example 4, the composition of the base alloy is changed to the compositions disclosed in table 10. Then, Experimental Example 4 is performed under the same conditions as Experimental Example 1 and Experimental Example 2 until the heat treatment process. Then, differences of the coercivity and the oxidation resistance between the occasions that the heat treatment is performed in one stage and the occasions that the heat treatment is performed in two stages are confirmed. The results are shown in table 10. When the heat treatment is performed in one stage, it is performed at 450° C. for 60 minutes. When the heat treatment is performed in two stages, the first heat treatment is performed at 350° C. for 60 minutes, and the second heat treatment is performed at 425° C. for 60 minutes. The heat treatment is carried out under the condition that the material of the setter is set to carbon the same as Experimental Example 1. Furthermore, when the crystals exist in the ribbon before the heat treatment, the coercivity in the one-stage heat treatment increases signally, so that the two-stage heat treatment is not carried out. In addition, for the samples after the two-stage heat treatment, the content (α) of M1+M2+Cu in the nanocrystal parts and the content (β) of M1+M2+Cu in the amorphous parts are measured using the 3DAP. Furthermore, the average grain size of the nanocrystal and the crystallinity degree of the nanocrystal parts are also measured. In addition, as for the oxidation resistance, the high temperature and humidity resistance test is carried out at a temperature of 80° C. and a humidity of 85%, and the surface is observed every 30 minutes to judge whether it is rusted or not. The case in which the time until the rust is generated in the two-stage heat treatment is 2.0 times or more long than the time until the rust is generated in the one-stage heat treatment is considered as excellent; the case of 1.2 times or more and less than 2.0 times is considered as good; the case of more than 1.0 time and less than 1.2 times is considered as fair; and the case of 1.0 time or less is considered as poor. Furthermore, the excellence degree is arranged in the order of excellent, good, fair, poor, and in the Experimental Example, the cases having an evaluation excellent, good, or fair are considered as acceptable.

TABLE 10

| Sample No | Example/ Comparative Example | Composition | Existence of crystal before heat treatment | One-stage heat treatment Coercivity (A/m) | Two-stage heat treatment Coercivity (A/m) | Oxidation resistance | Nano-crystal part M1 + M2 + Cu (α) (at %) | Armor-phous part M1 + M2 + Cu (β) (at %) | Sub-com-ponent ratio (α)/(β) | Nano-crystal average grain size (nm) | Crystal-linity degree (%) |
|---|---|---|---|---|---|---|---|---|---|---|---|
| 209 | Example | Fe86.9Cu0.1P1Si2B9C1 | Armorphous | 5.5 | 4.6 | Good | 3.1 | 34.4 | 0.09 | 18 | 58 |
| 210 | Example | Fe80.9Cu0.1P1Si8B9C1 | Armorphous | 3.6 | 3.0 | Good | 1.8 | 22.5 | 0.08 | 18 | 58 |
| 211 | Example | Fe82.9Cu0.1P2Si2B9C4 | Armorphous | 4.9 | 4.1 | Good | 4.5 | 37.5 | 0.12 | 19 | 52 |
| 212 | Example | Fe76.9Cu0.1P2Si8B9C4 | Armorphous | 3.5 | 2.9 | Excellent | 4.3 | 21.5 | 0.20 | 21 | 53 |
| 213 | Example | Fe83.3Si6B10Cu0.7 | Armorphous | 6.2 | 5.1 | Excellent | 4.1 | 24.1 | 0.17 | 25 | 62 |
| 214 | Example | Fe83.3Si4B10P2Cu0.7 | Armorphous | 4.9 | 4.1 | Good | 3.2 | 23.2 | 0.14 | 23 | 61 |
| 215 | Example | Fe83.3Si2B10P4Cu0.7 | Armorphous | 4.9 | 4.1 | Good | 3.9 | 31.2 | 0.13 | 18 | 52 |
| 216 | Example | Fe83.3B10P6Cu0.7 | Armorphous | 3.8 | 3.1 | Good | 4.1 | 40.3 | 0.10 | 18 | 53 |
| 217 | Example | Fe83.3Si3B5P8Cu0.7 | Armorphous | 4.3 | 3.6 | Excellent | 4.2 | 37.2 | 0.11 | 18 | 54 |
| 218 | Example | Fe83.3Si1B13P2Cu0.7 | Armorphous | 7.2 | 6.0 | Good | 4.1 | 39.2 | 0.10 | 18 | 65 |

In each Example of Experimental Example 4, even if the composition is properly changed, when the heat treatment is carried out in two stages, compared with the occasion that the heat treatment is carried out in one stage, the coercivity is signally reduced and the oxidation resistance is improved. In addition, when the heat treatment is carried out in two stages, there are M1, M2 and/or Cu in the nanocrystal parts.

Experimental Example 5

In Experimental Example 5, the composition of the base alloy is changed to the compositions disclosed in table 11. Then, Experimental Example 5 is performed under the same conditions as Experimental Example 1 and Experimental Example 2 until the heat treatment process. Then, differences of the coercivity and the oxidation resistance between the occasions that the heat treatment is performed in one stage and the occasions that the heat treatment is performed in two stages are confirmed. The results are shown in table 11. When the heat treatment is performed in one stage, it is performed at 550° C. for 60 minutes. When the heat treatment is performed in two stages, the first heat treatment is performed at 425° C. for 60 minutes, and the second heat treatment is performed at 525° C. for 60 minutes. The heat treatment is carried out under the condition that the material of the setter is set to carbon the same as Experimental Example 1. Furthermore, when the crystals exist in the ribbon before the heat treatment, the coercivity in the one-stage heat treatment increases signally, so that the two-stage heat treatment is not carried out. In addition, for the samples after the two-stage heat treatment, the content (α) of M1+M2+Cu in the nanocrystal parts and the content (β) of M1+M2+Cu in the amorphous parts are measured using the 3DAP. Furthermore, the average grain size of the nanocrystals and the crystallinity degree of the nanocrystal parts are also measured. In addition, as for the oxidation resistance, the high temperature and humidity resistance test is carried out at a temperature of 80° C. and a humidity of 85%, and the surface is observed every 30 minutes to judge whether it is rusted or not. The case in which the time until the rust is generated in the two-stage heat treatment is 2.0 times or more long than the time until the rust is generated in the one-stage heat treatment is considered as excellent; the case of 1.2 times or more and less than 2.0 times is considered as good; the case of more than 1.0 time and less than 1.2 times is considered as fair; and the case of 1.0 time or less is considered as poor. Furthermore, the excellence degree is arranged in the order of excellent, good, fair, and poor, and in the experimental example, the cases having an evaluation excellent, good, or fair are considered as acceptable.

TABLE 11

| Sample No | Example/ Comparative Example | Composition | Existence of crystal before heat treatment | One-stage heat treat-ment Coer-civity (A/m) | Two-stage heat treatment Coer-civity (A/m) | Oxidation resistance | Nano-crystal part M1 + M2 + Cu (α) (at %) | Armor-phous part M1 + M2 + Cu (β) (at %) | Sub-com-ponent ratio (α)/(β) | Nano-crystal average grain size (nm) | Crystal-linity degree (%) |
|---|---|---|---|---|---|---|---|---|---|---|---|
| 219 | Example | Fe77.5Cu1Nb3Si13.5B5 | Microcrystal | 10.8 | 5.4 | Fair | 1.8 | 20.1 | 0.09 | 44 | 72 |
| 220 | Example | Fe75.5Cu1Nb3Si13.5B7 | Armorphous | 1.4 | 0.9 | Good | 2.8 | 19.2 | 0.15 | 21 | 65 |
| 221 | Example | Fe71.5Cu1Nb3Si13.5B11 | Armorphous | 1.0 | 0.6 | Excellent | 5.2 | 19.5 | 0.27 | 22 | 52 |
| 222 | Example | Fe69.5Cu1Nb3Si13.5B13 | Armorphous | 1.1 | 0.7 | Excellent | 7.8 | 19.6 | 0.40 | 23 | 53 |
| 223 | Example | Fe74.5Nb3Si13.5B9 | Microcrystal | 16.8 | 8.2 | Good | 4.2 | 21.1 | 0.20 | 51 | 55 |
| 224 | Example | Fe74.4Cu0.1Nb3Si13.5B9 | Armorphous | 1.6 | 1.0 | Good | 3.1 | 19.4 | 0.16 | 32 | 45 |
| 225 | Example | Fe71.5Cu3Nb3Si13.5B9 | Armorphous | 1.4 | 0.9 | Good | 3.4 | 19.7 | 0.17 | 14 | 53 |
| 226 | Comparative Example | Fe71Cu3.5Nb3Si13.5B9 | Crystal | 14890 | — | — | — | — | — | — | — |

TABLE 11-continued

| Sample No | Example/ Comparative Example | Composition | Existence of crystal before heat treatment | One-stage heat treatment Coercivity (A/m) | Two-stage heat treatment Coercivity (A/m) | Oxidation resistance | Nanocrystal part M1 + M2 + Cu (α) (at %) | Armorphous part M1 + M2 + Cu (β) (at %) | Sub-component ratio (α)/(β) | Nanocrystal average grain size (nm) | Crystallinity degree (%) |
|---|---|---|---|---|---|---|---|---|---|---|---|
| 227 | Example | Fe79.5Cu1Nb3Si9.5B9 | Microcrystal | 18.2 | 10.2 | Fair | 1.6 | 1.1 | 0.08 | 64 | 75 |
| 228 | Example | Fe75.5Cu1Nb3Si11.5B9 | Armorphous | 1.0 | 0.8 | Good | 3.2 | 19.3 | 0.17 | 22 | 54 |
| 229 | Example | Fe73.5Cu1Nb3Si15.5B7 | Armorphous | 0.9 | 0.6 | Good | 3.0 | 16.8 | 0.18 | 22 | 56 |
| 230 | Example | Fe71.5Cu1Nb3Si15.5B9 | Armorphous | 0.9 | 0.6 | Good | 3.2 | 17.0 | 0.19 | 21 | 60 |
| 231 | Example | Fe69.5Cu1Nb3Si17.5B9 | Armorphous | 1.1 | 0.7 | Good | 3.2 | 17.6 | 0.18 | 24 | 69 |
| 232 | Example | Fe75Si15B10 | Armorphous | 5.0 | 1.2 | Fair | 0.2 | 25.0 | 0.01 | 0.1 | 5 |
| 233 | Example | Fe74.7Cr2.3Si11B11C2 | Armorphous | 2.0 | 0.8 | Fair | 0.3 | 23.0 | 0.01 | 15 | 3 |
| 234 | Comparative Example | Fe76.5Cu1Si13.5B9 | Crystal | 3360 | — | — | — | — | — | — | — |
| 235 | Example | Fe75.5Cu1Nb1Si13.5B9 | Armorphous | 1.6 | 1.0 | Good | 2.9 | 19.2 | 0.15 | 21 | 44 |
| 236 | Example | Fe71.5Cu1Nb5Si13.5B9 | Armorphous | 1.1 | 0.7 | Good | 3.9 | 20.4 | 0.19 | 22 | 54 |
| 237 | Example | Fe66.5Cu1Nb10Si13.5B9 | Armorphous | 1.2 | 0.8 | Excellent | 5.1 | 22.2 | 0.23 | 23 | 58 |
| 238 | Example | Fe73.5Cu1Ti3Si13.5B9 | Armorphous | 1.7 | 1.1 | Good | 3.1 | 19.2 | 0.16 | 21 | 51 |
| 239 | Example | Fe73.5Cu1Zr3Si13.5B9 | Armorphous | 1.7 | 1.1 | Good | 3.1 | 18.2 | 0.17 | 22 | 47 |
| 240 | Example | Fe73.5Cu1Hf3Si13.5B9 | Armorphous | 1.7 | 1.1 | Good | 3.2 | 19.3 | 0.17 | 22 | 49 |
| 241 | Example | Fe73.5Cu1V3Si13.5B9 | Armorphous | 1.6 | 1.0 | Good | 3.3 | 19.4 | 0.17 | 22 | 49 |
| 242 | Example | Fe73.5Cu1Ta3Si13.5B9 | Armorphous | 1.8 | 1.2 | Good | 3.4 | 19.6 | 0.17 | 21 | 45 |
| 243 | Example | Fe73.5Cu1Mo3Si13.5B9 | Armorphous | 1.6 | 1.0 | Good | 3.1 | 19.3 | 0.16 | 23 | 43 |
| 244 | Example | Fe73.5Cu1Hf1.5Nb1.5Si13.5B9 | Armorphous | 1.6 | 1.0 | Good | 3.2 | 19.3 | 0.17 | 23 | 54 |
| 245 | Example | Fe79.5Cu1Nb2Si9.5B9C1 | Armorphous | 1.8 | 1.1 | Good | 3.5 | 17.4 | 0.20 | 23 | 42 |
| 246 | Example | Fe79Cu1Nb2Si9B5C4 | Armorphous | 1.7 | 1.1 | Good | 3.0 | 23.5 | 0.13 | 23 | 45 |
| 247 | Example | Fe73.5Cu1Nb3Si13.5B8C1 | Armorphous | 0.9 | 0.6 | Good | 3.1 | 19.4 | 0.16 | 23 | 57 |
| 248 | Example | Fe73.5Cu1Nb3Si13.5B5C4 | Armorphous | 1.2 | 0.8 | Good | 3.1 | 19.7 | 0.16 | 21 | 53 |
| 249 | Example | Fe69.5Cu1Nb3Si17.5B8C1 | Armorphous | 1.5 | 0.9 | Good | 3.3 | 16.4 | 0.20 | 21 | 53 |
| 250 | Example | Fe69.5Cu1Nb3Si17.5B5C4 | Armorphous | 1.6 | 1.0 | Good | 3.2 | 17.4 | 0.18 | 19 | 55 |

In each Example of Experimental Example 5, even if the composition is properly changed, when the heat treatment is carried out in two stages, compared with the occasion that the heat treatment is carried out in one stage, the coercivity is signally reduced and the oxidation resistance is improved. In addition, when the heat treatment is carried out in two stages, there are M1, M2 and/or Cu in the nanocrystal parts.

Experimental Example 6

Experimental Example 6 is performed under conditions the same as Experimental Example 3 and evaluated except that the composition of the base alloy is changed to the compositions disclosed in table 12. The results are shown in table 12.

TABLE 12

| Sample No | Example/ Comparative Example | Composition | Existence of crystal before heat treatment | One-stage heat treatment Coercivity (A/m) | Two-stage heat treatment Coercivity (A/m) | Oxidation resistance | Nanocrystal part M1 + M2 + Cu (α) (at %) | Armorphous part M1 + M2 + Cu (β) (at %) | Sub-component ratio (α)/(β) | Nanocrystal average grain size (nm) | Crystallinity degree (%) |
|---|---|---|---|---|---|---|---|---|---|---|---|
| 251 | Example | Fe79.9Nb7B9P3Si1Cu0.1 | Armorphous | 2.3 | 1.8 | Excellent | 8.0 | 48.3 | 0.17 | 7 | 56 |
| 252 | Example | Fe77.9Nb7B9P3Si3Cu0.1 | Armorphous | 2.2 | 1.8 | Excellent | 8.5 | 53.2 | 0.16 | 8 | 57 |
| 253 | Example | Fe75.9Nb7B9P3Si5Cu0.1 | Armorphous | 2.1 | 1.8 | Excellent | 8.3 | 52.3 | 0.16 | 7 | 54 |
| 254 | Example | Fe70.9Nb7B9P3Si10Cu0.1 | Armorphous | 1.8 | 1.5 | Excellent | 8.2 | 48.2 | 0.17 | 7 | 58 |
| 255 | Example | Fe65.9Nb7B9P3Si15Cu0.1 | Armorphous | 1.5 | 1.2 | Excellent | 8.4 | 47.1 | 0.18 | 7 | 56 |
| 256 | Example | Fe78.9Nb7B9P3Si1Cu0.1C1 | Armorphous | 2.4 | 2.0 | Excellent | 8.2 | 43.2 | 0.19 | 7 | 57 |
| 257 | Example | Fe76.9Nb7B9P3Si3Cu0.1C1 | Armorphous | 2.3 | 2.0 | Excellent | 8.3 | 44.6 | 0.19 | 8 | 58 |
| 258 | Example | Fe74.9Nb7B9P3Si5Cu0.1C1 | Armorphous | 2.2 | 2.1 | Excellent | 8.2 | 45.2 | 0.18 | 7 | 56 |
| 259 | Example | Fe69.9Nb7B9P3Si10Cu0.1C1 | Armorphous | 2.1 | 1.9 | Excellent | 7.2 | 43.2 | 0.17 | 6 | 57 |
| 260 | Example | Fe64.9Nb7B9P3Si15Cu0.1C1 | Armorphous | 1.8 | 1.6 | Excellent | 7.4 | 47.5 | 0.16 | 7 | 59 |

In each Example, even if the composition is properly changed, when the heat treatment is carried out in two stages, compared with the occasion that the heat treatment is carried out in one stage, the coercivity is signally reduced and the oxidation resistance is improved. In addition, when the heat treatment is carried out in two stages, there are M1, M2 and/or Cu in the nanocrystal parts.

Experimental Example 7

In Experimental Example 7, various raw materials are respectively weighed to obtain the base alloy with the compositions shown in table 13. Then, after vacuuming inside the chamber, the base alloy is made by melting the various raw material metals by high frequency heating.

Thereafter, after the base alloy that is made is heated and melted and a metal at a melting state of 1500° C. is made, the metal is injected by the gas atomizing method under the composition conditions shown in the following table 13 to make powder. In Experimental Example 7, the gas injection temperature is set to 100° C. and the vapor pressure inside the chamber is set to 4 hPa to make the samples. The vapor pressure adjustment is carried out using Ar gas to which the dew-point adjustment is carried out.

Then, for each powder, the one-stage heat treatment or the two-stage heat treatment is carried out under conditions shown in table 13, and the magnetic characteristic and the oxidation resistance are evaluated. Furthermore, a range with an observation range of 40 nm×40 nm×200 nm is observed using the 3DAP (three-dimensional atom probe) for each sample, and it is confirmed that all the sample powder includes nanocrystal parts and amorphous parts. Furthermore, the material of the setter during the heat treatment is set to carbon. Furthermore, the 3DAP is used to measure the nanocrystal part composition and the amorphous part composition. The results are shown in table 13. Furthermore, the average grain size of the nanocrystal in the nanocrystal parts and the crystallinity degree in the nanocrystal parts are also calculated using the 3DAP. The results are shown in table 14. In addition, as for the oxidation resistance, a high temperature and humidity resistance test is carried out for 1 hours at a temperature of 80° C. and a humidity of 85%, and the surface is observed to judge whether it is rusted or not.

TABLE 13

| Sample No | Example/ Comparative Example | Composition | Heat treatment conditions: First time Temperature (° C.) | First time Time (h) | Second time Temperature (° C.) | Second time Time (h) | Saturation magnetic flux density (T) | Coercivity (A/m) | Oxidation resistance |
|---|---|---|---|---|---|---|---|---|---|
| 261 | Comparative Example | Fe73.5Cu1Nb3Si13.5B9 | — | — | 550 | 1 | 1.12 | 94 | Rusted |
| 262 | Example | Fe73.5Cu1Nb3Si13.5B9 | 400 | 1 | 525 | 1 | 1.20 | 54 | Not rusted |
| 263 | Comparative Example | Fe84Nb7B9 | — | — | 650 | 1 | 1.50 | 264 | Rusted |
| 264 | Example | Fe84Nb7B9 | 450 | 1 | 600 | 1 | 1.52 | 88 | Not rusted |

TABLE 14

| Sample No | Example/ Comparative Example | Composition | Nanocrystal part composition (at %): Fe | Si | M1 | M2 | Cu | M1 + M2 + Cu (α) | Amorphous part composition (at %): Fe | Si | M1 | M2 | Cu | M1 + M2 + Cu (β) | Sub-component ratio (α)/(β) | Nanocrystal average grain size (nm) | Crystallinity degree (%) |
|---|---|---|---|---|---|---|---|---|---|---|---|---|---|---|---|---|---|
| 261 | Comparative Example | Fe73.5Cu1Nb3Si13.5B9 | 80.5 | 19.5 | 0.0 | 0.0 | 0.0 | 0.0 | 71.2 | 7.1 | 5.3 | 16.3 | 0.1 | 21.7 | 0.00 | 24 | 52 |
| 262 | Example | Fe73.5Cu1Nb3Si13.5B9 | 79.1 | 18.5 | 0.6 | 1.8 | 0.1 | 2.5 | 71.2 | 7.1 | 5.2 | 16.3 | 0.2 | 21.7 | 0.12 | 22 | 32 |
| 263 | Comparative Example | Fe84Nb7B9 | 100.0 | 0.0 | 0.0 | 0.0 | 0.0 | 0.0 | 58.8 | 0.0 | 19.4 | 21.8 | 0.0 | 41.2 | 0.00 | 8 | 65 |
| 264 | Example | Fe84Nb7B9 | 93.3 | 0.0 | 3.4 | 3.3 | 0.0 | 6.7 | 58.7 | 0.0 | 19.6 | 21.7 | 0.0 | 41.3 | 0.16 | 7 | 51 |

In each Example in which the heat treatment is carried out in two stages, M1, M2 and/or Cu are/is included in the nanocrystal parts, and the oxidation resistance is improved. On the contrary, in each Comparative Example in which the heat treatment is carried out in one stage, M1, M2 and Cu are not included in the nanocrystal parts, and the oxidation resistance is reduced.

Experimental Example 8

In Experimental Example 8, for sample No. 65 of table 5, one portion of Fe is substituted with X1 to perform and evaluate the experiment. Furthermore, M3 is added to perform and evaluate the experiment. The results are shown in table 15.

TABLE 15

| Sample No | Example/ Comparative Example | Composition | Existence of crystal before heat treatment | One-stage heat treatment Coercivity (A/m) | Two-stage heat treatment Coercivity (A/m) | Oxidation resistance | Nano-crystal part M1 + M2 + Cu (α) (at %) | Armor-phous part M1 + M2 + Cu (β) (at %) | Sub-com-ponent ratio (α)/(β) | Nano-crystal average grain size (nm) | Crystal-linity degree (%) |
|---|---|---|---|---|---|---|---|---|---|---|---|
| 65 | Example | Fe86Nb5B9 | Amorphous | 16.0 | 11.1 | Good | 4.8 | 39.2 | 0.12 | 10 | 58 |
| 271 | Example | (Fe0.85Ni0.15)86Nb5B9 | Amorphous | 15.0 | 13.2 | Good | 4.2 | 40.2 | 0.10 | 14 | 57 |
| 272 | Example | (Fe0.85Co0.15)86Nb5B9 | Amorphous | 18.1 | 12.1 | Good | 4.6 | 40.1 | 0.11 | 13 | 54 |
| 273 | Example | Fe83Nb5B9S3 | Amorphous | 18.3 | 12.5 | Good | 4.9 | 38.9 | 0.13 | 13 | 56 |
| 274 | Example | Fe83Nb5B9O3 | Amorphous | 18.3 | 12.1 | Good | 4.8 | 39.9 | 0.12 | 14 | 54 |
| 275 | Example | Fe83Nb5B9N3 | Amorphous | 18.4 | 12.4 | Good | 4.8 | 37.8 | 0.13 | 12 | 56 |

In each Example, even if the composition is properly changed, when the heat treatment is carried out in two stages, compared with the occasion that the heat treatment is carried out in one stage, the coercivity is signally reduced and the oxidation resistance is improved. In addition, when the heat treatment is carried out in two stages, there are M1, M2 and/or Cu in the nanocrystal parts.

REFERENCE SIGNS LIST

11 nanocrystal part
13 amorphous part
31 nozzle
32 melted metal
33 roll
34 ribbon
35 chamber

What is claimed is:

1. A soft magnetic alloy, comprising nanocrystal parts and amorphous parts, wherein the nanocrystal parts comprise αFe(—Si) as a main component, and comprise at least one of elements selected from B, P, C, Ti, Zr, Hf, Nb, Ta, Mo, V, W, Cr, Al, Mn, Zn, and Cu as a sub-component; when a total content ratio of the sub-component in the nanocrystal parts is set as α (at %), and a total content ratio of the sub-component of the nanocrystal parts included in the amorphous parts is set as β (at %), $0.01 \leq (\alpha/\beta) \leq 0.40$; and a crystallinity degree is 5% or more and 70% or less;

the soft magnetic alloy is represented by a composition formula $Fe_aCu_bM1_cSi_dM2_e$, in which M1 is at least one of elements selected from Ti, Zr, Hf, Nb, Ta, Mo, V, W, Cr, Al, Mn, and Zn;

M2 is at least one of elements selected from B, P, and C;

$a+b+c+d+e=100$ $64.9 \leq a \leq 94.5$
$0.0 \leq b \leq 3.0$
$0.0 \leq c \leq 15.5$
$0.0 \leq d \leq 17.5$
$2.0 \leq e \leq 23.0$; and
at least one of c and d is not 0.

2. The soft magnetic alloy according to claim 1, wherein the crystallinity degree is 15% or more and 70% or less.

3. The soft magnetic alloy according to claim 1, wherein $0.5 \leq \alpha \leq 20$ in which the total content ratio of the sub-component in the nanocrystal parts is set as α (at %).

4. The soft magnetic alloy according to claim 1, wherein $10 \leq \beta \leq 60$ in which the total content ratio of the sub-component of the nanocrystal parts included in the amorphous parts is set as β (at %).

5. The soft magnetic alloy according to claim 1, wherein $0.05 < (\alpha/\beta) < 0.20$ in which the total content ratio of the sub-component in the nanocrystal parts is set as α (at %), and the total content ratio of the sub-component of the nanocrystal parts included in the amorphous parts is set as β (at %).

6. The soft magnetic alloy according to claim 1, wherein $0.0 \leq c \leq 15.0$ and $2.0 \leq e \leq 20.0$.

7. The soft magnetic alloy according to claim 1, wherein the soft magnetic is in a ribbon-like.

8. The soft magnetic alloy according to claim 1, wherein the soft magnetic is in a powder-like.

9. A magnetic component, comprising the soft magnetic alloy according to claim 1.

10. A soft magnetic alloy, comprising nanocrystal parts and amorphous parts, wherein the nanocrystal parts comprise αFe(—Si) as a main component, and comprise at least one of elements select from B, P, C, Ti, Zr, Hf, Nb, Ta, Mo, V, W, Cr, Al, Mn, Zn, and Cu as a sub-component; when a total content ratio of the sub-component in the nanocrystal parts is set as α (at %), and a total content ratio of the sub-component of the nanocrystal parts included in the amorphous parts is set as β (at %), $0.01 \leq (\alpha/\beta) \leq 0.40$; and a crystallinity degree is 5% or more and 70% or less;

the soft magnetic alloy is a soft magnetic alloy represented by a composition formula $(Fe_{1-z}X1_z)_a Cu_bM1_cSi_dM2_eM3_f$, wherein X1 is at least one of elements selected from Co and Ni;

M1 is at least one of elements selected from Ti, Zr, Hf, Nb, Ta, Mo, V, W, Cr, Al, Mn, and Zn;

M2 is at least one of elements selected from B, P, and C;

M3 is at least one of elements selected from S, O, and N;

$$a+b+c+d+e+f=100$$

$0.00 \leq z \leq 0.15$ $64.9 \leq a \leq 94.5$ $0.0 \leq b \leq 3.0$ $0.0 \leq c \leq 15.5$ $0.0 \leq d \leq 17.5$ $2.0 \leq e \leq 23.0$ $0.0 \leq f \leq 3.0$; and at least one of c and d is not 0.

11. A magnetic component, comprising the soft magnetic alloy according to claim 10.

* * * * *